US012110894B2

(12) United States Patent
Shin et al.

(10) Patent No.: US 12,110,894 B2
(45) Date of Patent: Oct. 8, 2024

(54) ROTARY COMPRESSOR

(71) Applicant: LG ELECTRONICS INC., Seoul (KR)

(72) Inventors: Jinung Shin, Seoul (KR); Joonhong Park, Seoul (KR); Seoungmin Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/282,011

(22) PCT Filed: Mar. 16, 2022

(86) PCT No.: PCT/KR2022/003675
§ 371 (c)(1),
(2) Date: Sep. 14, 2023

(87) PCT Pub. No.: WO2022/197092
PCT Pub. Date: Sep. 22, 2022

(65) Prior Publication Data

US 2024/0151231 A1 May 9, 2024

(30) Foreign Application Priority Data

Mar. 19, 2021 (KR) ..... 10-2021-036176

(51) Int. Cl.
*F04C 18/344* (2006.01)
*F04C 18/356* (2006.01)
*F04C 29/02* (2006.01)

(52) U.S. Cl.
CPC ..... *F04C 29/028* (2013.01); *F04C 18/3441* (2013.01); *F04C 18/356* (2013.01);
(Continued)

(58) Field of Classification Search
CPC F04C 18/3441; F04C 18/356; F04C 18/3564; F04C 29/02; F04C 29/023;
(Continued)

(56) References Cited

U.S. PATENT DOCUMENTS 5,685,703 A * 11/1997 Fukuoka ..... F04C 29/023 418/94
2015/0267703 A1* 9/2015 Yanagawa ..... F04C 18/3446 418/259
2020/0149531 A1* 5/2020 Park ..... F04C 18/3442

FOREIGN PATENT DOCUMENTS

JP 4060149 3/2008
JP 2013-213438 10/2013
(Continued)

OTHER PUBLICATIONS

JP2016-125403A—Nagano et al.—Vane Type Compressor—Jul. 11, 2016—the English Machine Translation. (Year: 2016).*
(Continued)

*Primary Examiner* — Theresa Trieu
(74) *Attorney, Agent, or Firm* — KED & ASSOCIATES

(57) ABSTRACT

A rotary compressor is provided that may include a casing having an oil storage space; a cylinder; a main bearing and a sub bearing; a rotary shaft; a roller having a vane slot and a back pressure chamber; and at least one vane. An oil supply hole that communicates the back pressure chamber with the oil storage space may pass through the main bearing or the sub bearing, or through the roller. Accordingly, as high-pressure oil is supplied directly to a rear end surface of the vane, it is possible to increase efficiency of the compressor by increasing a back pressure on the vane and suppressing a delay in starting the compressor, and it is also possible to reduce collision noise and wear in the vane and the cylinder by suppressing vibration of the vane.

16 Claims, 17 Drawing Sheets

(52) U.S. Cl.
CPC ..... *F04C 29/023* (2013.01); *F04C 2240/30* (2013.01); *F04C 2240/56* (2013.01); *F04C 2240/603* (2013.01)

(58) Field of Classification Search
CPC .... F04C 29/025; F04C 29/028; F04C 23/008; F04C 2240/50; F04C 2240/60; F04C 2240/603
See application file for complete search history.

(56) References Cited

FOREIGN PATENT DOCUMENTS

| | | |
|---|---|---|
| JP | 2015-178820 | 10/2015 |
| JP | 2016-125403 | 7/2016 |
| KR | 10-2017-0091666 | 8/2017 |
| KR | 10-2180179 | 11/2020 |

OTHER PUBLICATIONS

International Search Report dated Jul. 12, 2022 issued in Application No. PCT/KR2022/003675.
Korean Office Action dated Apr. 7, 2022 issued in Application No. 10-2021-0036176.
Korean Notice of Allowance dated Oct. 4, 2022 issued in Application No. 10-2021-0036176.

* cited by examiner

ROTARY COMPRESSOR

CROSS-REFERENCE TO RELATED PATENT APPLICATIONS

This application is a U.S. National Stage Application under 35 U.S.C. § 371 of PCT Application No. PCT/KR2022/003675, filed Mar. 16, 2022, which claims priority to Korean Patent Application No. 10-2021-0036176, filed Mar. 19, 2021, whose entire disclosures are hereby incorporated by reference.

TECHNICAL FIELD

A vane rotary compressor in which a vane is coupled to a rotary roller is disclosed herein.

BACKGROUND ART

Rotary compressors may be classified into a type in which a vane is slidably inserted into a cylinder to be brought into contact with a roller, and another type in which a vane is slidably inserted into a roller to be brought into contact with a cylinder. In general, the former is called a roller eccentric rotary compressor (hereinafter, referred to as a "rotary compressor"), and the latter is referred to as a vane concentric rotary compressor (hereinafter, referred to as a "vane rotary compressor").

As for a rotary compressor, a vane inserted in a cylinder is pulled out toward a roller by elastic force or back pressure to come into contact with an outer circumferential surface of the roller. On the other hand, as for a vane rotary compressor, a vane inserted in a roller rotates together with the roller, and is pulled out by centrifugal force and back pressure to come into contact with an inner circumferential surface of a cylinder.

A rotary compressor independently forms compression chambers as many as the number of vanes per revolution of a roller, and the compression chambers simultaneously perform suction, compression, and discharge strokes. On the other hand, a vane rotary compressor continuously forms as many compression chambers as the number of vanes per revolution of a roller, and the compression chambers sequentially perform suction, compression, and discharge strokes. Accordingly, the vane rotary compressor has a higher compression ratio than the rotary compressor. Therefore, the vane rotary compressor is more suitable for high pressure refrigerants, such as R32, R410a, and $CO_2$, which have low ozone depletion potential (ODP) and global warming index (GWP).

Such a vane rotary compressor is disclosed in Patent Document 1 (Japanese Laid-Open Patent Application No. JP2013-213438A). The vane rotary compressor disclosed in Patent Document 1 has a structure in which suction refrigerant is filled in an inner space of a motor room as in a low-pressure type but a plurality of vanes are slidably inserted into a rotating roller.

In Patent Document 1, a back pressure chamber is disposed in a rear end portion of each vane to communicate with a back pressure pocket. The back pressure pocket is divided into a first pocket forming an intermediate pressure and a second pocket forming a discharge pressure or an intermediate pressure close to the discharge pressure. The first pocket communicates with the back pressure chamber located at an upstream side and the second pocket communicates with the back pressure chamber located at a downstream side, with respect to a direction from a suction side to a discharge side.

However, in the related art vane rotary compressor, shaking, trembling, or vibration, which is caused when the vane is spaced apart from the cylinder and then brought into contact with the cylinder due to a pressure difference between front and rear end surfaces during operation, may occur. In particular, this phenomenon may be severe at an initial startup of the compressor, which causes an initial startup failure, thereby lowering efficiency of the compressor and delaying air-conditioning effects when applied to an air conditioning device.

In addition, in the related art vane rotary compressor, the trembling of the vane intensively occurs around a proximal point, and thereby an inner circumferential surface of the cylinder or a front surface of the vane may be worn around the proximal point. As a result, vibration noise in a specific area may be increased and leakage between compression chambers may occur, thereby decreasing compression efficiency.

In addition, in the related art vane rotary compressor, pressure pulsation may be caused by a non-uniform pressure of oil supplied toward a rear end surface of the vane. Accordingly, back pressure formed on the rear end surface of the vane may become inconsistent, causing more severe trembling of the vane.

Those problems become more serious when a high-pressure refrigerant, such as R32, R410a, or $CO_2$, is used. In more detail, when the high-pressure refrigerant is used, a same level of cooling capability may be obtained as that obtained when using a relatively low-pressure refrigerant, such as R134a, even though a volume of each compression chamber is reduced by increasing the number of vanes. However, as the number of vanes increases, a friction area between the vanes and the cylinder increases accordingly. As a result, a bearing surface on a rotary shaft is reduced, which makes a behavior of the rotary shaft more unstable, ending up with a further increase in mechanical friction loss. This may be more greatly affected under a heating and low-temperature condition, a high-pressure ratio condition ($Pd/Ps \geq 6$), and a high-speed driving condition (80 Hz or more).

DISCLOSURE OF INVENTION

Technical Problem

Therefore, embodiments disclosed herein provide a rotary compressor capable of enhancing compressor efficiency by suppressing a delay of a start operation of the compressor.

Embodiments disclosed herein also provide a rotary compressor capable of suppressing a vane from trembling, shaking, or vibrating when the vane is spaced apart from a cylinder during operation.

Embodiments disclosed herein further provide a rotary compressor capable of maintaining back pressure with respect to a vane by uniformly supplying high-pressure oil to a rear end surface of the vane.

The Embodiments disclosed herein furthermore provide a rotary compressor capable of reducing suction loss or compression loss by suppressing wear of an inner circumferential surface of a cylinder or a front end surface of a vane.

Embodiments disclosed herein provide a rotary compressor capable of suppressing trembling between a vane and a cylinder by supplying oil stored in a casing directly to a rear end surface of a vane passing through a proximal point.

Embodiments disclosed herein also provide a rotary compressor capable of suppressing an excessive increase in back pressure supporting a vane, which passes through a proximal point, while directly supplying high-pressure oil to a rear end surface of the vane.

Embodiments disclosed herein further provide a rotary compressor capable of suppressing trembling of a vane even when a high-pressure refrigerant, such as R32, R410a, or $CO_2$ is used.

Solution to Problem

Embodiments disclosed herein provide a rotary compressor that may include a casing, a cylinder, a main bearing, a sub bearing, a rotary shaft, a roller, and at least one vane. The casing defines an oil storage space therein. The cylinder is fixed in the casing to form a compression space. The main bearing and the sub bearing are disposed on both sides of the cylinder in an axial direction and provided with a main bearing hole and a sub bearing hole formed therethrough, respectively, in the axial direction. The rotary shaft is supported by being inserted through the main bearing hole of the main bearing and the sub bearing hole of the sub bearing. The roller is disposed on the rotary shaft to be eccentric from the compression space. At least one vane slot is formed along an outer circumferential surface of the roller, and a back pressure chamber communicates with an inner end of the vane slot. The vane is slidably inserted into the vane slot so that its front end surface is brought into contact with an inner circumferential surface of the cylinder to divide the compression space into a plurality of compression chambers. An oil supply hole may be formed through the main bearing or the sub bearing such that the back pressure chamber communicates with the oil storage space. With this structure, high-pressure oil may be directly supplied to a rear end surface of the vane to increase back pressure on the vane, suppress a delay in starting the compressor to enhance compressor efficiency, and suppress trembling (or vibration) of the vane to reduce hitting noise and wear between the vane and the cylinder.

The sub bearing disposed to face the oil storage space may include a sub plate portion coupled to one side surface of the cylinder in the axial direction, and a sub boss portion extending from the sub plate portion in the axial direction, and having the sub bearing hole formed therethrough. The oil supply hole may be formed through the sub bush portion. With this structure, oil stored in the oil storage space may be rapidly supplied to the rear end surface of the vane, thereby suppressing a delay of initial startup.

The oil supply hole may be formed through the sub bush portion between an axial end surface of the sub bush portion and one side surface of the sub plate portion facing the roller. With this structure, a lower end of the oil supply hole may be disposed deep in the oil storage space, so that oil of the oil storage space may be stably supplied to the rear end surface of the vane even during abnormal operation, thereby constantly maintaining back pressure.

The oil supply hole may be formed through between an inner circumferential surface of the sub bearing hole of the sub bush portion and one side surface of the sub plate portion facing the roller. With this structure, the oil introduced into the sub bearing surface by centrifugal force may be quickly supplied to the rear end surface of the vane, thereby suppressing a delay of initial startup.

An oil groove may be formed in the inner circumferential surface of the sub bearing hole. The oil supply hole may communicate with a middle portion of the oil groove. With this structure, oil introduced into a sub bearing surface may be more quickly supplied to the rear end surface of the vane.

The sub bearing disposed to face the oil storage space may include a sub plate portion coupled to one axial side surface of the cylinder, and a sub boss portion extending from the sub plate portion in the axial direction, and having the rotary shaft inserted therethrough to be supported. The oil supply hole may be formed through the sub plate portion. With this structure, by reducing a length of the oil supply hole, oil may be quickly supplied toward the rear end surface of the vane.

The oil supply hole may be inclinedly formed through between both side surfaces of the sub plate portion in the axial direction. This may reduce the length of the oil supply hole while linearly machining the oil supply guide groove.

The oil supply hole may include a first hole portion extending radially from an outer circumferential surface of the sub plate portion, and a second hole portion formed through from an inside of the first hole portion toward one axial side surface of the sub plate portion. With this structure, by further reducing a substantial length of the oil supply hole, oil may be more quickly supplied toward the rear end surface of the vane.

The sub bearing disposed to face the oil storage space may include a sub plate portion coupled to one axial side surface of the cylinder, and a sub boss portion extending from the sub plate portion in the axial direction, and having the sub bearing hole formed therethrough. The oil supply hole may be formed through the sub bush portion. An oil pump may be further disposed in the sub bush portion, and the oil supply hole may communicate with an outlet of the oil pump. This may allow oil to be more quickly and constantly supplied toward the rear end surface of the vane.

An oil passage through which oil stored in the oil storage space of the casing is suctioned may be formed in a hollow shape inside of the rotary shaft. A plurality of back pressure pockets communicating with the oil passage so as to have different pressure may be disposed in the main bearing or the sub bearing. The plurality of back pressure pockets may be disposed at preset or predetermined distances in a circumferential direction in a surface facing an axial side surface of the roller. The oil supply hole may be formed between the plurality of back pressure pockets such that at least a portion thereof overlaps the back pressure chamber in the axial direction. Accordingly, the back pressure chamber and the oil supply hole may periodically communicate with each other, and thus, the rear end surface of the vane may maintain appropriate back pressure at a required position.

An inner diameter of the oil supply hole may be smaller than or equal to an inner diameter of the back pressure chamber. With this structure, an appropriate amount of oil may be supplied to the back pressure chamber and at the same time an increase in oil at a corresponding portion of the sub bearing may be suppressed due to the oil supply hole.

The oil supply hole may be formed such that an inner diameter thereof at an upper end facing the roller is larger than or equal to an inner diameter at a lower end belonging to the oil storage space. Accordingly, differential pressure in the oil supply hole may be generated so that oil in the oil storage space may be quickly supplied to the rear end surface of the vane through the oil supply hole.

The oil supply hole may have a communication groove formed between an upper end thereof facing the roller and the back pressure pocket facing the upper end in the circumferential direction. With this structure, a larger differential pressure may be generated between the oil supply hole and the back pressure pocket, so that oil may be more quickly supplied to the rear end surface of the vane through the oil supply hole.

Also, Embodiments disclosed herein provide a rotary compressor that includes a casing, a cylinder, a main bearing, a sub bearing, a rotary shaft, a roller, and at least one vane. The casing defines an oil storage space therein. The cylinder is fixed inside the casing. The main bearing and the sub bearing may be coupled to the cylinder to form the compression space together with the cylinder. The rotary shaft is supported in a radial direction by the main bearing and the sub bearing. The roller is disposed in the rotary shaft to be eccentric from the compression space. At least one vane slot is formed along an outer circumferential surface of the roller, and a back pressure chamber communicates with an inner end of the vane slot. The vane is slidably inserted into the vane slot so that its front end surface is brought into contact with an inner circumferential surface of the cylinder to divide the compression space into a plurality of compression chambers. The rotary shaft may have an oil passage defined therein in a hollow shape. An oil supply hole may be formed through an inner circumferential surface of the oil passage toward the back pressure chamber. This may allow oil of high pressure to be directly supplied to a rear end surface of the vane, thereby increasing back pressure with respect to the vane.

An oil supply guide groove communicating with the back pressure chamber may further be disposed in an axial side surface of the roller. The oil supply hole may be formed through between the inner circumferential surface of the oil passage and an inner circumferential surface of the oil supply guide groove. This may facilitate machining of the oil supply hole while reducing pressure pulsation in the back pressure chamber communicating with the oil supply hole so as to stabilize a behavior of the vane.

The rotary shaft comprises an oil passage hole formed through an outer circumferential surface thereof from a middle of the oil passage toward the main bearing or the sub bearing. An inner diameter of the oil supply hole may be smaller than or equal to an inner diameter of the oil passage hole. This may suppress an increase in overall friction loss between the cylinder and the vane by preventing an excessive back pressure from acting on the rear end surface of the vane.

Advantageous Effects of Invention

In a rotary compressor according to an embodiment, an oil supply hole may be formed through a main bearing or a sub bearing such that a back pressure chamber may communicate with an oil storage space. With this structure, back pressure on the vane may be increased by supplying high-pressure oil directly to a rear end surface of a vane, efficiency of the compressor may be enhanced by suppressing a delay in starting the compressor, and collision noise and wear between the vane and the cylinder may be reduced by suppressing trembling (vibration) of the vane.

Also, in a rotary compressor according to an embodiment, an oil supply hole may be formed through a sub bush portion extending from a sub bearing toward an oil storage space. With this structure, oil stored in the oil storage space may be rapidly supplied to a rear end surface of a vane, thereby suppressing a delay of initial startup.

Also, in a rotary compressor according to an embodiment, an oil supply hole may be formed through between an axial end surface of a sub bush portion and one side surface of a sub plate portion facing a roller. With this structure, a lower end of the oil supply hole may be disposed deep in an oil storage space, so that oil of the oil storage space may be stably supplied to a rear end surface of a vane during abnormal operation.

In a rotary compressor according to an embodiment, an oil supply hole may be formed through between an inner circumferential surface of a sub bearing hole of a sub bush portion and one side surface of a sub plate portion facing a roller. With this structure, oil flowing to a sub bearing surface by centrifugal force may be quickly supplied to a rear end surface of a vane.

Also, in a rotary compressor according to an embodiment, an oil supply hole may be formed through a sub plate portion. With this structure, a length of the oil supply hole may be reduced, and thus, oil may be quickly supplied toward a rear end surface of a vane.

In addition, in a rotary compressor according to an embodiment, an oil supply hole may be formed through the sub bush portion, and a lower end of the oil supply hole may communicate with an outlet of an oil pump. This may allow oil to be more quickly and constantly supplied toward a rear end surface of a vane.

In a rotary compressor according to an embodiment, an oil supply hole may be formed between a plurality of back pressure pockets such that at least a portion thereof overlaps a back pressure chamber in an axial direction. Accordingly, the back pressure chamber and the oil supply hole may periodically communicate with each other, and thus, a rear end surface of a vane may maintain appropriate back pressure at a required position.

In addition, in a rotary compressor according to an embodiment, the oil supply hole may be formed such that an inner diameter thereof at an upper end facing a roller is larger than or equal to an inner diameter at a lower end belonging to an oil storage space. Accordingly, differential pressure in the oil supply hole may be generated so that oil in the oil storage space may be quickly supplied to a rear end surface of a vane through the oil supply hole.

In a rotary compressor according to an embodiment, a communication groove may be formed between an upper end of an oil supply hole facing a roller and a back pressure pocket facing the oil supply hole in a circumferential direction. With this structure, larger differential pressure may be generated between the oil supply hole and the back pressure pocket, so that oil may be more quickly supplied to a rear end surface of a vane through the oil supply hole.

In a rotary compressor according to an embodiment, an oil supply hole may be formed through an inner circumferential surface of an oil passage toward a back pressure chamber. This may allow oil of high pressure to be directly supplied to a rear end surface of a vane, thereby increasing back pressure with respect to the vane.

In a rotary compressor according to an embodiment, an oil supply guide groove communicating with a back pressure chamber may be formed in one end of the back pressure chamber, and an oil supply hole may be formed through between an inner circumferential surface of an oil passage and an inner circumferential surface of the oil supply guide groove. This may facilitate machining of the oil supply hole while reducing pressure pulsation in the back pressure chamber communicating with the oil supply hole so as to stabilize a behavior of a vane.

In a rotary compressor according to an embodiment, an inner diameter of the oil supply hole may be smaller than or equal to an inner diameter of an oil passage hole. This may suppress an increase in overall friction loss between a cylinder and a vane by preventing an excessive back pressure from acting on a rear end surface of the vane.

BRIEF DESCRIPTION OF DRAWINGS

FIG. 8A illustrates the related art, and FIG. 8B illustrates an embodiment;

MODE FOR THE INVENTION

Description will now be given of a vane rotary compressor according to exemplary embodiments disclosed herein, with reference to the accompanying drawings. For reference, an oil supply hole according to embodiments may be equally applied to a vane rotary compressor in which a vane is slidably inserted into the roller. For example, the embodiments may be applied not only to an example in which the vane slot is inclined but also to an example in which the vane slot is formed radially. Hereinafter, an example in which a vane slot is inclined relative to a roller and an inner circumferential surface of a cylinder has an asymmetric elliptical shape will be described as a representative example.

Figure 1:
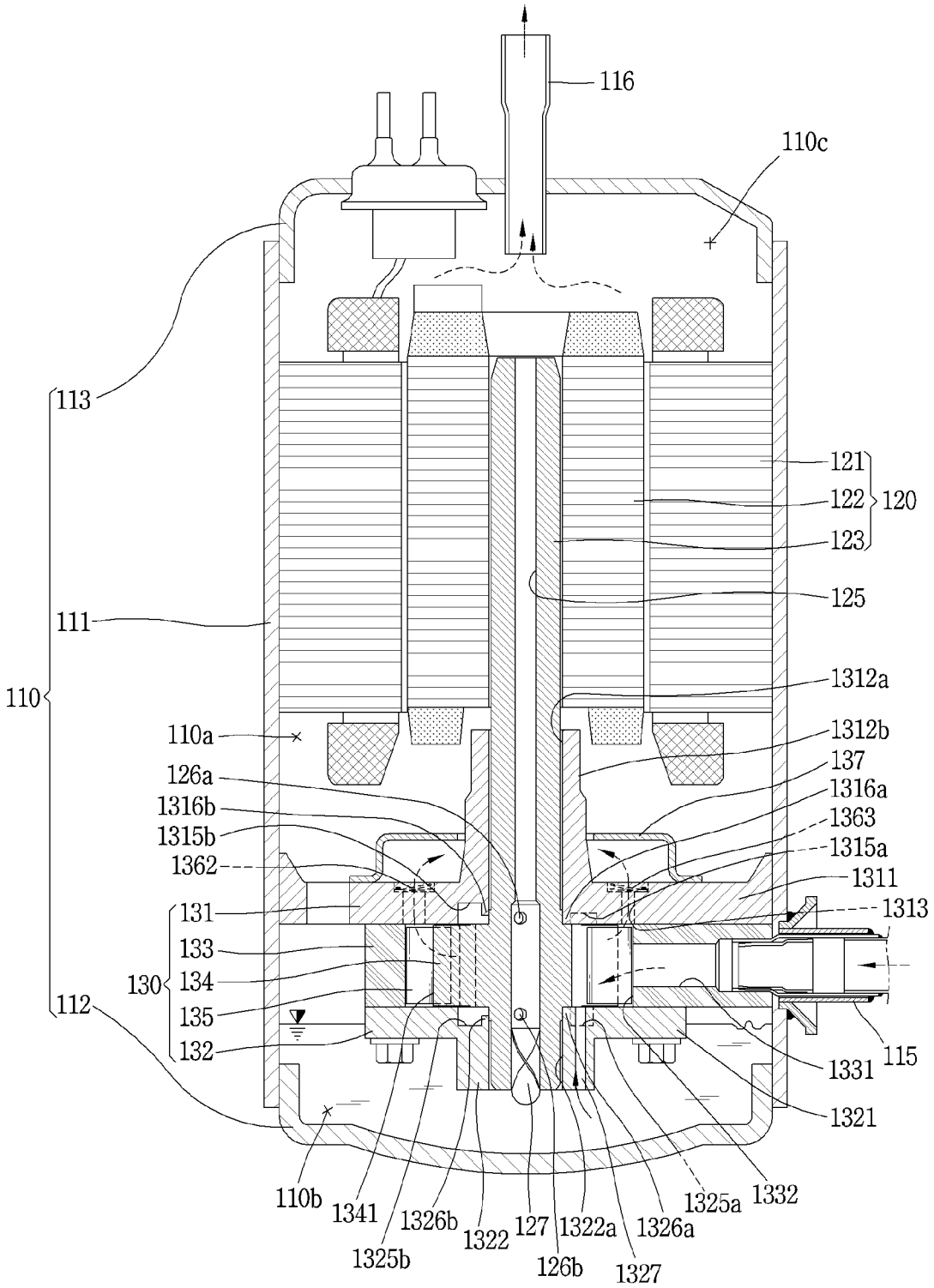
FIG. 1 is a cross-sectional view of a vane rotary compressor according to an embodiment.
Figure 2:
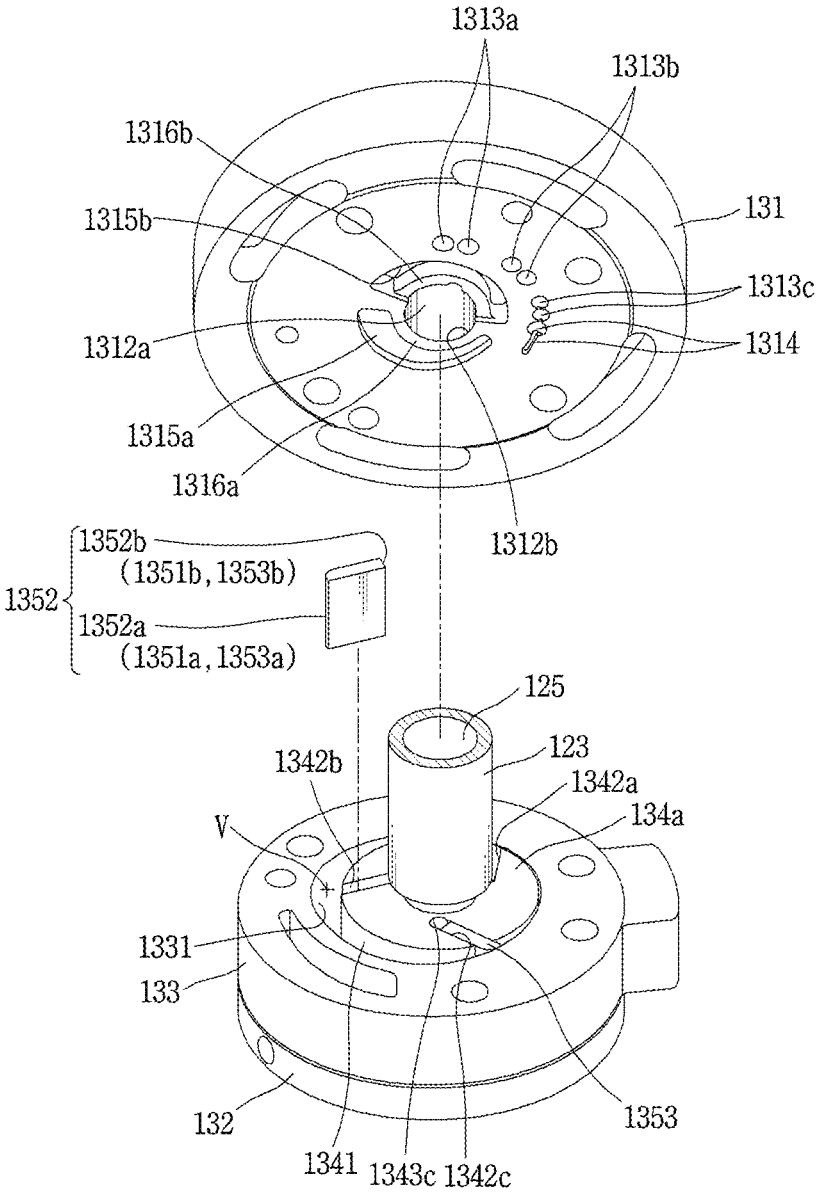
FIG. 2 is an exploded perspective view of a compression unit in FIG. 1.
Figure 3:
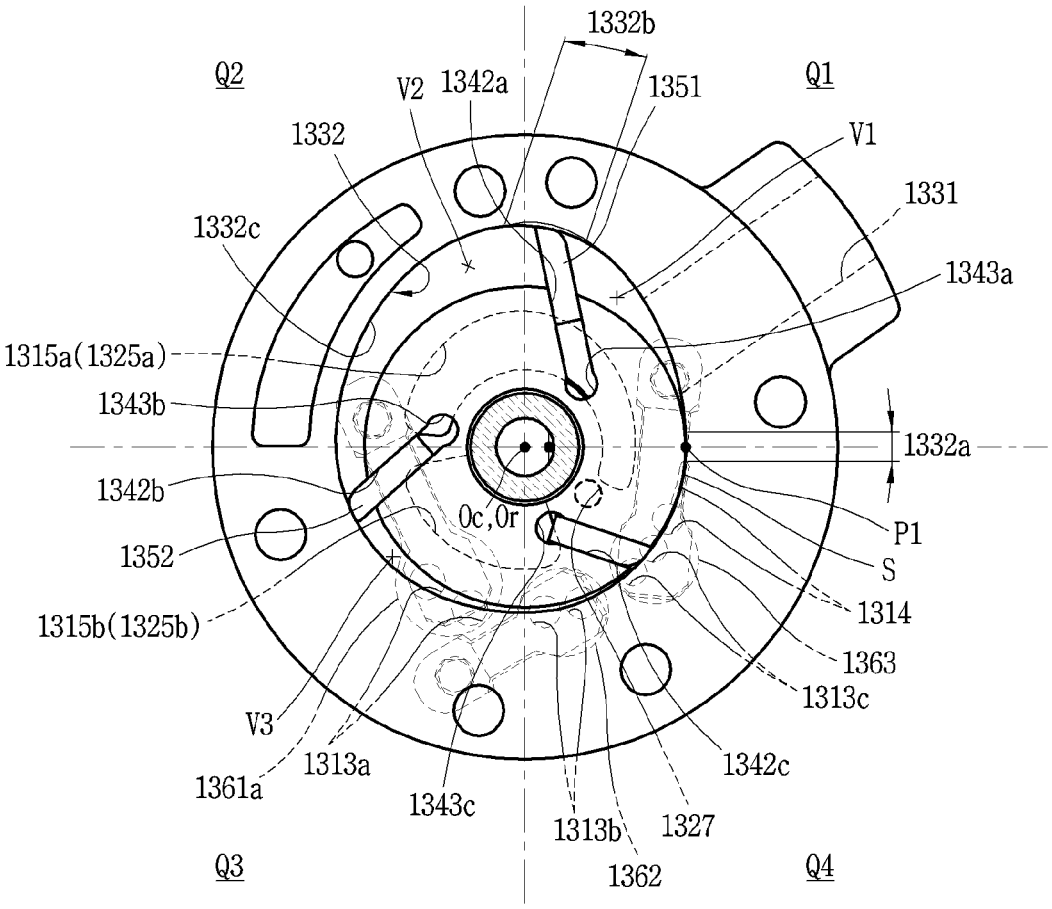
FIG. 3 is a planar view illustrating an assembled state of the compression unit in FIG. 2.

FIG. 1 is a cross-sectional view of a vane rotary compressor according to an embodiment, FIG. 2 is an exploded perspective view illustrating a compression unit in FIG. 1, and FIG. 3 is an assembled planar view of the compression unit in FIG. 2.

Referring to FIG. 1, a vane rotary compressor according to an embodiment includes a casing 110, a driving (or drive) motor 120, and a compression unit 130. The drive motor 120 is installed in an upper inner space 110*a* of the casing 110, and the compression unit 130 is installed in a lower inner space 110*a* of the casing 110. The drive motor 120 and the compression unit 130 are connected through a rotary shaft 123.

The casing 110 that defines an outer appearance of the compressor may be classified as a vertical type and a horizontal type according to a compressor installation method. As for the vertical type casing, the drive motor 120 and the compression unit 130 are disposed at upper and lower sides in an axial direction, respectively. As for the horizontal type casing, the drive motor 120 and the compression unit 130 are disposed at left and right or lateral sides, respectively. The casing according to this embodiment may be illustrated as the vertical type.

The casing 110 includes an intermediate shell 111 having a cylindrical shape, a lower shell 112 covering a lower end of the intermediate shell 111, and an upper shell 113 covering an upper end of the intermediate shell 111. The drive motor 120 and the compression unit 130 may be inserted into the intermediate shell 111 to be fixed thereto, and a suction pipe 115 may penetrate through the intermediate shell 111 to be directly connected to the compression unit 130. The lower shell 112 may be coupled to the lower end of the intermediate shell 111 in a sealing manner, and an oil storage space 110*b* in which oil to be supplied to the compression unit 130 is stored may be formed below the compression unit 130. The upper shell 113 may be coupled to the upper end of the intermediate shell 111 in a sealing manner, and an oil separation space 110*c* may be formed above the drive motor 120 to separate oil from refrigerant discharged from the compression unit 130.

The drive motor 120 that constitutes a motor unit supplies power to cause the compression unit 130 to be driven. The drive motor 120 includes a stator 121, a rotor 122, and the rotary shaft 123.

The stator 121 may be fixedly inserted into the casing 110. The stator 121 may be fixed to an inner circumferential surface of the casing 110 in a shrink-fitting manner, for example. For example, the stator 121 may be press-fitted into an inner circumferential surface of the intermediate shell 111.

The rotor 122 may be rotatably inserted into the stator 121, and the rotary shaft 123 may be press-fitted into a center of the rotor 122. Accordingly, the rotary shaft 123 rotates concentrically together with the rotor 122.

An oil flow path 125 having a hollow hole shape is formed in a central portion of the rotary shaft 123, and oil passage holes 126*a* and 126*b* are formed through a middle portion of the oil flow path 125 toward an outer circumferential surface of the rotary shaft 123. The oil passage holes 126*a* and 126*b* include a first oil passage hole 126*a* belonging to a range of a main bush portion 1312 described hereinafter and a second oil passage hole 126*b* belonging to a range of a sub bush bearing portion 1322. Each of the first oil passage hole 126*a* and the second oil passage hole 126*b* may be provided as one or as a plurality. In this embodiment, each of the first and second oil passage holes is provided as a plurality.

An oil pickup 127 may be installed in or at a middle or lower end of the oil flow path 125. A gear pump, a viscous pump, or a centrifugal pump may be used for the oil pickup 127. This embodiment illustrates a case in which the centrifugal pump is employed. Accordingly, when the rotary shaft 123 rotates, oil filled in the oil storage space 110*b* is pumped by the oil pickup 127 and is suctioned along the oil flow path 125, so as to be introduced into a sub bearing surface 1322*b* of the sub bush portion 1322 through the second oil passage hole 126*b* and into a main bearing surface 1312*b* of the main bush portion 1312 through the first oil passage hole 126*a*.

The compression unit 130 includes a main bearing 131, a sub bearing 132, a cylinder 133, a roller 134, and a plurality of vanes 135 (1351, 1352, and 1353). The main bearing 131 and the sub bearing 132 are respectively provided at upper and lower parts or portions of the cylinder 133 to define a compression space V together with the cylinder 133, the roller 134 is rotatably installed in the compression space V, and the plurality of vanes 1351, 1352, and 1353 are slidably inserted into the roller 134 to divide the compression space V into a plurality of compression chambers.

Referring to FIGS. 1 to 3, the main bearing 131 may be fixedly installed in the intermediate shell 111 of the casing 110. For example, the main bearing 131 may be inserted into the intermediate shell 111 and welded thereto.

The main bearing 131 may be coupled to an upper end of the cylinder 133 in a close contact manner. Accordingly, the main bearing 131 defines an upper surface of the compression space V, and supports an upper surface of the roller 134 in the axial direction while supporting an upper-half portion of the rotary shaft 123 in a radial direction.

The main bearing 131 may include a main plate portion 1311 and a main bush portion 1312. The main plate portion 1311 covers an upper part or portion of the cylinder 133 to be coupled thereto, and the main bush portion 1312 axially extends from a center of the main plate portion 1311 toward the drive motor 120 so as to support the upper portion of the rotary shaft 123.

The main plate portion 1311 may have a disk shape, and an outer circumferential surface of the main plate portion 1311 may be fixed to the inner circumferential surface of the intermediate shell 111 in a close contact manner. One or more discharge ports 1313*a*, 1313*b*, and 1313*c* may be formed in the main plate portion 1311. A plurality of discharge valves 1361, 1362, and 1363 configured to open and close the respective discharge ports 1313*a*, 1313*b*, and 1313*c* may be installed on an upper surface of the main plate portion 1311. A discharge muffler 137 having a discharge space (no reference numeral) may be provided at an upper part or portion of the main plate portion 1311 to accommodate the discharge ports 1313*a*, 1313*b*, and 1313*c*, and the discharge valves 1361, 1362, and 1363. The discharge ports will be described hereinafter.

A first main back pressure pocket 1315*a* and a second main back pressure pocket 1315*b* may be formed in a lower surface of the main plate portion 1311 facing the upper surface of the roller 134, of both axial side surfaces of the main plate portion 1311. The first main back pressure pocket 1315*a* and the second main back pressure pocket 1315*b* each having an arcuate shape may be disposed at a predetermined interval in a circumferential direction. Each of the first main back pressure pocket 1315*a* and the second main back pressure pocket 1315*b* may have an inner circumferential surface with a circular shape, but may have an outer circumferential surface with an oval or elliptical shape in consideration of vane slots described hereinafter.

The first main back pressure pocket 1315*a* and the second main back pressure pocket 1315*b* may be formed within an outer diameter range of the roller 134. Accordingly, the first main back pressure pocket 1315*a* and the second main back pressure pocket 1315*b* may be separated from the compression space V. However, the first main back pressure pocket 1315*a* and the second main back pressure pocket 1315*b* may slightly communicate with each other through a gap between a lower surface of the main plate portion 1311 and the upper surface of the roller 134 facing each other unless a separate sealing member is provided therebetween.

The first main back pressure pocket 1315*a* forms a pressure lower than a pressure formed in the second main back pressure pocket 1315*b*, for example, forms an intermediate pressure between a suction pressure and a discharge pressure. Oil (refrigerant oil) may pass through a fine passage between a first main bearing protrusion 1316*a* described hereinafter and the upper surface 134*a* of the roller 134 so as to be introduced into the first main back pressure pocket 1315*a*. The first main back pressure pocket 1315*a* may be formed in the range of a compression chamber forming intermediate pressure in the compression space V. This may allow the first main back pressure pocket 1315*a* to maintain the intermediate pressure.

The second main back pressure pocket 1315*b* may form a pressure higher than that in the first main back pressure pocket 1315*a*, for example, a discharge pressure or an intermediate pressure between a suction pressure close to the discharge pressure and the discharge pressure. Oil flowing into the main bearing hole 1312*a* of the main bearing 1312 through the first oil passage hole 126*a* may be introduced into the second main back pressure pocket 1315*b*. The second main back pressure pocket 1315*b* may be formed in the range of a compression chamber forming a discharge pressure in the compression space V. This may allow the second main back pressure pocket 1315*b* to maintain the discharge pressure.

In addition, a first main bearing protrusion 1316*a* and a second main bearing protrusion 1316*b* may be formed on inner circumferential sides of the first main back pressure pocket 1315*a* and the second main back pressure pocket 1315*b*, respectively, in a manner of extending from the main bearing surface 1312*b* of the main bush portion 1312. Accordingly, the first main back pressure pocket 1315*a* and the second main back pressure pocket 1315*b* may be sealed from outside and simultaneously the rotary shaft 123 may be stably supported.

The first main bearing protrusion 1316*a* and the second main bearing protrusion 1316*b* may have a same height or different heights. For example, when the first main bearing protrusion 1316*a* and the second main bearing protrusion 1316*b* have the same height, an oil communication groove (not illustrated) or an oil communication hole (not illustrated) may be formed on an end surface of the second main bearing protrusion 1316*b* such that inner and outer circumferential surfaces of the second main bearing protrusion 1316*b* may communicate with each other. Accordingly, high-pressure oil (refrigerant oil) flowing into the main bearing surface 1312*b* may be introduced into the second main back pressure pocket 1315*b* through the oil communication groove (not illustrated) or the oil communication hole (not illustrated).

On the other hand, when the first main bearing protrusion 1316*a* and the second main bearing protrusion 1316*b* have different heights, the height of the second main bearing protrusion 1316*b* may be lower than the height of the first main bearing protrusion 1316*a*. Accordingly, high-pressure oil (refrigerant oil) flowing into the main bearing hole 1312*a* may be introduced into the second main back pressure pocket 1315*b* by flowing over the second main bearing protrusion 1316*b*.

The main bush portion 1312 may be formed in a hollow bush shape, and a first oil groove 1312*c* may be formed in an inner circumferential surface of the main bearing hole 1312*a* that defines an inner circumferential surface of the main bush portion 1312. The first oil groove 1312*c* may be formed in a straight or inclined shape between upper and lower ends of the main bush portion 1312 to communicate with the first oil passage hole 126*a*.

Referring to FIGS. 1 to 3, the sub bearing 132 may be coupled to a lower end of the cylinder 133 in a close contact manner. Accordingly, the sub bearing 132 defines a lower surface of the compression space V, and supports a lower surface of the roller 134 in the axial direction while supporting a lower-half portion of the rotary shaft 123 in the radial direction.

The sub bearing 132 may include a sub plate portion 1321 and the sub bush portion 1322. The sub plate portion 1321 covers a lower part or portion of the cylinder 133 to be coupled to thereto, and the sub bush portion 1322 axially extends from a center of the sub plate portion 1321 toward the lower shell 112 so as to support the lower portion of the rotary shaft 123. The sub plate portion 1321 may have a disk shape like the main plate portion 1311, and an outer circumferential surface of the sub plate portion 1321 may be spaced apart from the inner circumferential surface of the intermediate shell 111.

A first sub back pressure pocket 1325*a* and a second sub back pressure pocket 1325*b* may be formed on an upper surface of the sub plate portion 1321 facing the lower surface of the roller 134, of both axial side surfaces of the sub plate portion 1321. The first sub back pressure pocket 1325*a* and the second sub back pressure pocket 1325*b* may be symmetric to the first main back pressure pocket 1315*a* and the second main back pressure pocket 1315*b*, respectively, with respect to the roller 134.

For example, the first sub back pressure pocket 1325*a* and the first main back pressure pocket 1315*a* may be symmetric to each other, and the second sub back pressure pocket 1325*b* and the second main back pressure pocket 1315*b* may be symmetric to each other. Accordingly, a first sub bearing protrusion 1326*a* may be formed on an inner circumferential side of the first sub back pressure pocket 1325*a*, and a second sub bearing protrusion 1326*b* may be formed on an inner circumferential side of the second sub back pressure pocket 1325*b*.

Descriptions of the first sub back pressure pocket 1325*a* and the second sub back pressure pocket 1325*b*, and the first sub bearing protrusion 1326*a* and the second sub bearing protrusion 1326*b* are replaced by the descriptions of the first main back pressure pocket 1315*b* and the second main back pressure pocket 1316*b*, and the first main bearing protrusion 1316*a* and the second main bearing protrusion 1316*b*.

However, in some cases, the first sub back pressure pocket 1325*a* and the second sub back pressure pocket 1325*b* may be asymmetric to the first main back pressure pocket 1315*a* and the second main back pressure pocket 1315*b*, respectively, with respect to the roller 134. For example, the first sub back pressure pocket 1325*a* and the second sub back pressure pocket 1325*b* may be formed to be deeper than the first main back pressure pocket 1315*a* and the second main back pressure pocket 1315*b*, respectively.

In addition, an oil supply hole 1327 explained hereinafter may be formed between the first sub back pressure pocket 1325*a* and the second sub back pressure pocket 1325*b*, more specifically, between the first sub bearing protrusion 1326*a* and the second sub bearing protrusion 1326*b* or in a portion where the first sub bearing protrusion 1326*a* and the second sub bearing protrusion 1326*b* are connected to each other. For example, a first end defining an inlet 1327*a* of the oil supply hole 1327 may be submerged in the oil storage space 110*b*, and a second end defining an outlet 1327*b* of the oil supply hole 1327 may be located on a rotational path of the back pressure chamber 1343*a*, 1343*b*, 1343*c* in the upper surface of the sub plate portion 1321 facing the lower surface of the roller 134 described hereinafter. Accordingly, when the roller 134 rotates, the back pressure chamber 1343*a*, 1343*b*, 1343*c* may periodically communicate with the oil supply hole 1327, such that some of oil stored in the oil storage space 110*b* may be periodically supplied to the back pressure chamber 1343*a*, 1343*b*, 1343*c* through the oil supply hole 1327. This may allow the vane 1351, 1352, 1353 to be stably supported toward the inner circumferential surface 1332 of the cylinder 133. The oil supply hole 1327 will be described hereinafter.

The sub bush portion 1322 may be formed in a hollow bush shape, and an oil groove (not illustrated) may be formed in an inner circumferential surface of the sub bearing hole 1322*a* that defines an inner circumferential surface of the sub bush portion 1322. The oil groove (not illustrated) may be formed in a straight or inclined shape between upper and lower ends of the sub bush portion 1322 to communicate with the second oil passage hole 126*b*.

Although not illustrated in the drawings, the back pressure pockets 1315*a*, 1315*b*, 1325*a*, 1325*b* may be provided only at any one of the main bearing 131 and the sub bearing 132.

The discharge port 1313 may be formed in the main bearing 131 as described above. However, the discharge port may be formed in the sub bearing 132, formed in each of the main bearing 131 and the sub bearing 132, or formed by penetrating between inner and outer circumferential surfaces of the cylinder 133. This embodiment describes an example in which discharge ports 1313 are formed in the main bearing 131.

The discharge port 1313 may be provided as one. However, in this embodiment, a plurality of discharge ports 1313*a*, 1313*b*, and 1313*c* may be formed at predetermined intervals along a compression proceeding direction (or a rotational direction of the roller).

In general, in the vane rotary compressor, as the roller 134 is disposed eccentrically with respect to the compression space V, a proximal point P1 at which the roller 134 and the cylinder 133 almost come in contact with each other is generated between the outer circumferential surface 1341 of the roller 134 and the inner circumferential surface 1332 of the cylinder 133. The discharge port 1313 is formed adjacent to the proximal point P1. Accordingly, as the compression space V approaches the proximal point P, a gap between the inner circumferential surface 1332 of the cylinder 133 and the outer circumferential surface 1341 of the roller 134 greatly decreases, which makes it difficult to secure an area of the discharge port.

Thus, in this embodiment, the discharge port 1313 may be divided into a plurality of discharge ports 1313*a*, 1313*b*, and 1313*c* to be disposed along a direction of rotation (or direction of compression) of the roller 134. In addition, the plurality of discharge ports 1313*a*, 1313*b*, and 1313*c* may be formed individually, but may be formed as pairs, as illustrated in this embodiment.

For example, starting from a discharge port which is the most adjacent to proximal portion 1332*a*, the discharge ports 1313 may be aligned sequentially in the order of the first discharge port 1313*a*, the second discharge port 1313*b*, and the third discharge port 1313*c*. A gap between the first discharge port 1313*a* and the second discharge port 1313*b* and/or a gap between the second discharge port 1313*b* and the third discharge port 1313*c* may be approximately similar to a gap between a preceding vane and a succeeding vane, namely, a circumferential length of each compression chamber.

For example, a first gap between the first discharge port 1313*a* and the second discharge port 1313*b* may be substantially the same as a second gap between the second discharge port 1313*b* and the third discharge port 1313*c*. The first gap and the second gap may be substantially the same as circumferential lengths of the first compression chamber V1, the second compression chamber V2, and the third compression chamber V3. Accordingly, the first discharge port 1313*a* may communicate with the first compression chamber V1, the second discharge port 1313*a* may communicate with the second compression chamber V2, and the third discharge port 1313*c* may communicate with the third communication chamber V3, instead of the plurality of discharge ports 1313 communicating with one compression chamber or the plurality of compression chambers communicating with one discharge port 1313.

However, in this embodiment, when vane slots 1342*a*, 1342*b*, and 1342*c* described hereinafter are formed at unequal intervals, the circumferential length of each compression chamber V1, V2, V3 may be different, and the plurality of discharge ports may communicate with one compression chamber or one discharge port may communicate with the plurality of compression chambers.

In addition, a discharge groove 1314 may extend from the discharge port 1313 according to this embodiment. The discharge groove 1314 may extend in an arcuate shape along the compression proceeding direction (the rotational direction of the roller). Accordingly, refrigerant, which is not discharged from a preceding compression chamber, may be guided to the discharge port 1313 communicating with a following compression chamber through the discharge groove 1314, so as to be discharged together with refrigerant compressed in the succeeding compression chamber. As a result, residual refrigerant in the compression space V may be minimized to thereby suppress overcompression or excessive compression. Thus, efficiency of the compressor may be enhanced.

The discharge groove 1314 may extend from the last discharge port (for example, the third discharge port) 1313. In the vane rotary compressor, as the compression space V is divided into a suction chamber and a discharge chamber with the proximal portion (proximal point) 1332*a* interposed therebetween, the discharge port 1313 cannot overlap the proximal point P1 located at the proximal portion 1332*a* in consideration of sealing between the suction chamber and the discharge chamber. Accordingly, a remaining space S by which the inner circumferential surface 1332 of the cylinder 133 and the outer circumferential surface 1341 of the roller 134 are spaced apart is formed between the proximal point P1 and the discharge port 1313 along the circumferential direction, and refrigerant that is not discharged through the last discharge port 1313 remains in the remaining space S. This residual refrigerant may increase pressure of the last compression chamber to thereby cause a decrease in compression efficiency due to overcompression.

However, as in this embodiment, when the discharge groove 1314 extends from the last discharge port 1313 to the refrigerant remaining space S, refrigerant remaining in the refrigerant remaining space S may be discharged additionally by flowing back to the last discharge port 1313 through the discharge groove 1314, thereby effectively suppressing a decrease in compression efficiency due to overcompression in the last compression chamber.

Although not illustrated in the drawings, a residual discharge hole may be defined in the remaining space S in addition to the discharge groove 1314. The residual discharge hole may have a smaller inner diameter than the discharge port. Unlike the discharge port, the residual discharge hole may be configured to remain open at all times, rather than being opened and closed by the discharge valve.

In addition, the plurality of discharge ports 1313*a*, 1313*b*, and 1313*c* may be opened and closed by discharge valves 1361, 1362, and 1363, respectively. Each of the discharge valves 1361, 1362, and 1363 may be implemented as a cantilever type reed valve having one (first) end fixed and another (second) end free. These discharge valves 1361, 1362, and 1362 are widely known in the typical rotary compressor, so detailed description thereof has been omitted.

Referring to FIGS. 1 to 3, the cylinder 133 according to this embodiment may be in close contact with a lower surface of the main bearing 131 and be coupled to the main bearing 131 by a bolt together with the sub bearing 132. Accordingly, the cylinder 133 may be fixedly coupled to the casing 110 by the main bearing 131.

The cylinder 133 may be formed in an annular shape having a hollow space in its center to define the compression space V. The hollow space may be sealed by the main bearing 131 and the sub bearing 132 to define the compression space V, and the roller 134 described hereinafter may be rotatably coupled to the compression space V.

The cylinder 133 may be provided with a suction port 1331 penetrating from an outer circumferential surface to an inner circumferential surface thereof. However, the suction port may alternatively be formed through the main bearing 131 or the sub bearing 132.

The suction port 1331 may be formed at one (first) side of the proximal point P1 described hereinafter in the circumferential direction. The discharge port 1313 described above may be formed through the main bearing 131 at another (second) side of the proximal point P1 in the circumferential direction which is opposite to the suction port 1331.

The inner circumferential surface 1332 of the cylinder 133 may be formed in an elliptical shape. The inner circumferential surface 1332 of the cylinder 133 according to this embodiment may be formed in an asymmetric elliptical shape in which a plurality of ellipses, for example, four ellipses having different major and minor ratios are combined to have two origins.

The inner circumferential surface 1332 of the cylinder 133 according to this embodiment may be defined to have a first origin O, which is a rotational center of the roller 134 (an axial center or a diameter center of the cylinder) explained hereinafter and a second origin O' biased from the first origin O toward the proximal point P1.

An X-Y plane formed around the first origin O may define a third quadrant Q3 and a fourth quadrant Q4, and an X-Y plane formed around the second origin O' may define a first quadrant Q1 and a second quadrant Q2. The third quadrant Q3 may be formed by a third ellipse, the fourth quadrant Q4 may be formed by a fourth ellipse, the first quadrant Q1 may be formed by the first ellipse, and the second quadrant Q2 may be formed by the second ellipse.

In addition, the inner circumferential surface 1332 of the cylinder 133 may include proximal portion 1332*a*, a remote portion 1332*b*, and a curved portion 1332*c*. The proximal portion 1332*a* is a portion closest to the outer circumferential surface 1341 (or the center of rotation) of the roller 134, the remote portion 1332*b* is a portion farthest away from the outer circumferential surface 1341 of the roller 134, and the curved portion 1332*c* is a portion connecting the proximal portion 1332*a* and the remote portion 1332*b*.

The proximal portion 1332*a* may also be defined as the proximal point P1, and the first quadrant Q1 and the fourth quadrant Q4 may be divided based on the proximal portion 1332*a*. The suction port 1331 may be formed in the first quadrant Q1 and the discharge port 1313 may be formed in the fourth quadrant Q4, based on the proximal portion 1332*a*. Accordingly, when the vane 1351, 1352, 1353 passes the proximal point P1, a compression surface of the roller 134 in the rotational direction may receive a suction pressure as a low pressure but an opposite compression rear surface may receive a discharge pressure as a high pressure. Then, while passing the proximal point P1, the roller 134 may receive a greatest fluctuating pressure between a front end surface 1351*a*, 1352*a*, 1353*a* of each vane 1351, 1352, 1353 that comes in contact with the inner circumferential surface of the cylinder 133 and a rear end surface 1351*b*, 1352*b*, 1353*b* of each vane 1351, 1352, 1353 that faces the back pressure chamber 1343*a*, 1343*b*, 1343*c*. This may cause significant trembling of the vane 1351, 1352, 1353.

Accordingly, in this embodiment, an oil supply hole 1327 through which oil of high-pressure (a discharge pressure or a pressure similar to the discharge pressure) stored in the oil storage space 110*b* may be supplied to the back pressure chambers 1343*a*, 1343*b*, and 1343*c* may further be disposed. The oil supply hole 1327 will be described hereinafter.

Referring to FIGS. 1 to 3, the roller 134 may be rotatably disposed in the compression space V of the cylinder 133, and the plurality of vanes 1351, 1352, 1353 explained hereinafter may be inserted in the roller 134 at preset or predetermined gaps along the circumferential direction. Accordingly, the compression space V may be partitioned into as many compression chambers as the number of the plurality of vanes 1351, 1352, and 1353. This embodiment illustrates an example in which the plurality of vanes 1351, 1352, and 1353 are three, and thus, the compression space V is partitioned into three compression chambers V1, V2, and V3.

The outer circumferential surface 1341 of the roller 134 according to this embodiment may be formed in a circular shape, and the rotary shaft 123 may extend as a single body from or may be post-assembled and coupled to the rotational center Or of the roller 134. Accordingly, the rotational center Or of the roller 134 is coaxially located with an axial center (no reference numeral) of the rotary shaft 123, and the roller 134 rotates concentrically with the rotary shaft 123.

However, as described above, as the inner circumferential surface 1332 of the cylinder 133 is formed in the asymmetric elliptical shape biased in a specific direction, the rotational center Or of the roller 134 may be eccentrically disposed with respect to an outer diameter center Oc of the cylinder 133. Accordingly, one side of the outer circumferential surface 1341*b* of the roller 134 may be substantially brought into contact with the inner circumferential surface 1332 of the cylinder 133, more specifically, the proximal portion 1332*a*, thereby defining the proximal point P.

The proximal point P1 may be formed in the proximal portion 1332*a* as described above. Accordingly, an imaginary line passing through the proximal point P1 may correspond to a minor axis of an elliptical curve defining the inner circumferential surface 1332 of the cylinder 133.

In addition, the plurality of vane slots 1342*a*, 1342*b*, and 1342*c* may be formed in the outer circumferential surface 1341 of the roller 134 to be spaced apart from each other in the circumferential direction. The plurality of vanes 1351, 1352, and 1353 described hereinafter may be slidably inserted into the plurality of vane slots 1342*a*, 1342*b*, and 1342*c*, respectively.

The plurality of vane slots 1342*a*, 1342*b*, and 1342*c* may be defined as first vane slot 1342*a*, second vane slot 1342*b*, and third vane slot 1342*c* along a compression-proceeding direction (a rotational direction of the roller). The first vane slot 1342*a*, the second vane slot 1342*b*, and the third vane slot 1342*c* may be formed in the same manner at equal or unequal intervals along the circumferential direction.

For example, each of the vane slots 1342*a*, 1342*b*, and 1342*c* may be inclined by preset or predetermined angles with respect to the radial direction, so as to secure a sufficient length of each of the vanes 1351, 1352, and 1353. Accordingly, when the inner circumferential surface 1332 of the cylinder 133 is formed in the asymmetric elliptical shape, separation of the vanes 1351, 1352, and 1353 from the vane slots 1342*a*, 1342*b*, and 1342*c* may be suppressed even if a distance from the outer circumferential surface 1341 of the roller 134 to the inner circumferential surface 1332 of the cylinder 133 increases. This may result in enhancing the freedom of design for the inner circumferential surface 1332 of the cylinder 133.

A direction in which the vane slots 1342*a*, 1342*b*, and 1342*c* are inclined may be a reverse direction to the rotational direction of the roller 134. That is, the front end surfaces of the vanes 1351, 1352, and 1353 in contact with the inner circumferential surface 1332 of the cylinder 133 may be toward the rotational direction of the roller 134. This may be advantageous in that a compression start angle may be formed ahead in the rotational direction of the roller 134 so that compression may start quickly.

The back pressure chambers 1343*a*, 1343*b*, and 1343*c* may be formed to communicate with the inner ends of the vane slots 1342*a*, 1342*b*, and 1342*c*, respectively. The back pressure chambers 1343*a*, 1343*b*, and 1343*c* may be spaces in which oil (or refrigerant) of a discharge pressure or an intermediate pressure is filled to flow toward the rear sides of the vanes 1351, 1352, and 1353, that is, the vane rear end portions 1351*c*, 1352*c*, and 1353*c*. The vanes 1351, 1352, and 1353 may be pressed toward the inner circumferential surface of the cylinder 133 by the pressure of the oil (or refrigerant) filled in the back pressure chambers 1343*a*, 1343*b*, and 1343*c*. Hereinafter, a direction toward the cylinder based on a motion direction of the vane may be defined as the front, and an opposite side to the direction may be defined as the rear.

The back pressure chamber 1343*a*, 1343*b*, 1343*c* may be hermetically sealed by the main bearing 131 and the sub bearing 132. The back pressure chambers 1343*a*, 1343*b*, and 1343*c* may independently communicate with each of the back pressure pockets [1315*a*, and 1315*b*], [1325*a*, and 1325*b*], and may also communicate with each other through the back pressure pockets [1315*a*, and 1315*b*], and [1325*a*, and 1325*b*]

Referring to FIGS. 1 to 3, the plurality of vanes 1351, 1352, and 1353 according to this embodiment may be slidably inserted into the respective vane slots 1342*a*, 1342*b*, and 1342*c*. Accordingly, the plurality of vanes 1351, 1352, and 1353 may have substantially a same shape as the respective vane slots 1342*a*, 1342*b*, and 1342*c*.

For example, the plurality of vanes 1351, 1352, and 1353 are defined as first vane 1351, second vane 1352, and third vane 1353 along the rotational direction of the roller 134. The first vane 1351 may be inserted into the first vane slot 1342*a*, the second vane 1352 may be inserted into the second vane slot 1342*b*, and the third vane 1353 may be inserted into the third vane slot 1342*c*, respectively.

The plurality of vanes 1351, 1352, and 1353 may have substantially the same shape. More specifically, each of the plurality of vanes 1351, 1352, and 1353 may be formed substantially in a rectangular parallelepiped shape. The front end surface 1351*a*, 1352*a*, 1353*a* in contact with the inner circumferential surface 1332 of the cylinder 133 may be formed as a curved surface and the rear end surface 1351*b*, 1352*b*, 1353*b* facing the back pressure chamber 1343*a*, 1343*b*, 1343*c* may be formed as a linear surface.

In the vane rotary compressor having the hybrid cylinder, when power is applied to the drive motor 120, the rotor 122 of the drive motor 120 and the rotary shaft 123 coupled to the rotor 122 rotate together, causing the roller 134 coupled to the rotary shaft 123 or integrally formed therewith to rotate together with the rotary shaft 123. Then, the plurality of vanes 1351, 1352, and 1353 may be drawn out of the vane slots 1342*a*, 1342*b*, and 1342*c* by centrifugal force generated by the rotation of the roller 134 and back pressure of the back pressure chambers 1343*a*, 1343*b*, and 1343*c*, which support the rear end surfaces 1351*b*, 1353*b*, 1353*b* of the vanes 1351, 1352, and 1353, thereby being brought into contact with the inner circumferential surface 1332 of the cylinder 133.

The compression space V of the cylinder 133 may be partitioned by the plurality of vanes 1351, 1352, and 1353 into as many compression chambers (including suction chamber or discharge chamber) V1, V2, and V3 as the number of the vanes 1351, 1352, and 1353. The compression chambers V1, V2, and V3 may be changed in volume by the shape of the inner circumferential surface 1332 of the cylinder 133 and eccentricity of the roller 134 while moving in response to the rotation of the roller 134. Accordingly, refrigerant suctioned into the respective compression chambers V1, V2, and V3 may be compressed while moving along the roller 134 and the vanes 1351, 1352, and 1353, and discharged into the inner space of the casing 110. Such series of processes are repeatedly carried out.

On the other hand, as described above, in the rotary compressor according to this embodiment, the front end surface of each vane receives compression pressure and suction pressure at the same time in a section from the proximal point between the cylinder and the roller to the suction port. As a result, each vane may tremble due to pressure imbalance in the section. This trembling of the vane may cause leakage between the compression chambers, resulting in suction loss and compression loss, cause hitting noise and vibration between the cylinder and the vane, and aggravate suction loss and compression loss due to wear of the cylinder and the vane.

Accordingly, in this embodiment, the vane may be prevented from being pushed backward by increasing a back pressure of the back pressure chamber, resulting in suppressing trembling of the vane. For example, an oil supply hole may be disposed in the back pressure chamber to directly supply high-pressure oil stored in the oil storage space to the back pressure chamber. The oil supply hole may be formed through the main bearing or the sub bearing. Hereinafter, an example in which the oil supply hole is formed through the sub bearing will be mainly described; however, embodiments are not limited thereto.

Figure 4:
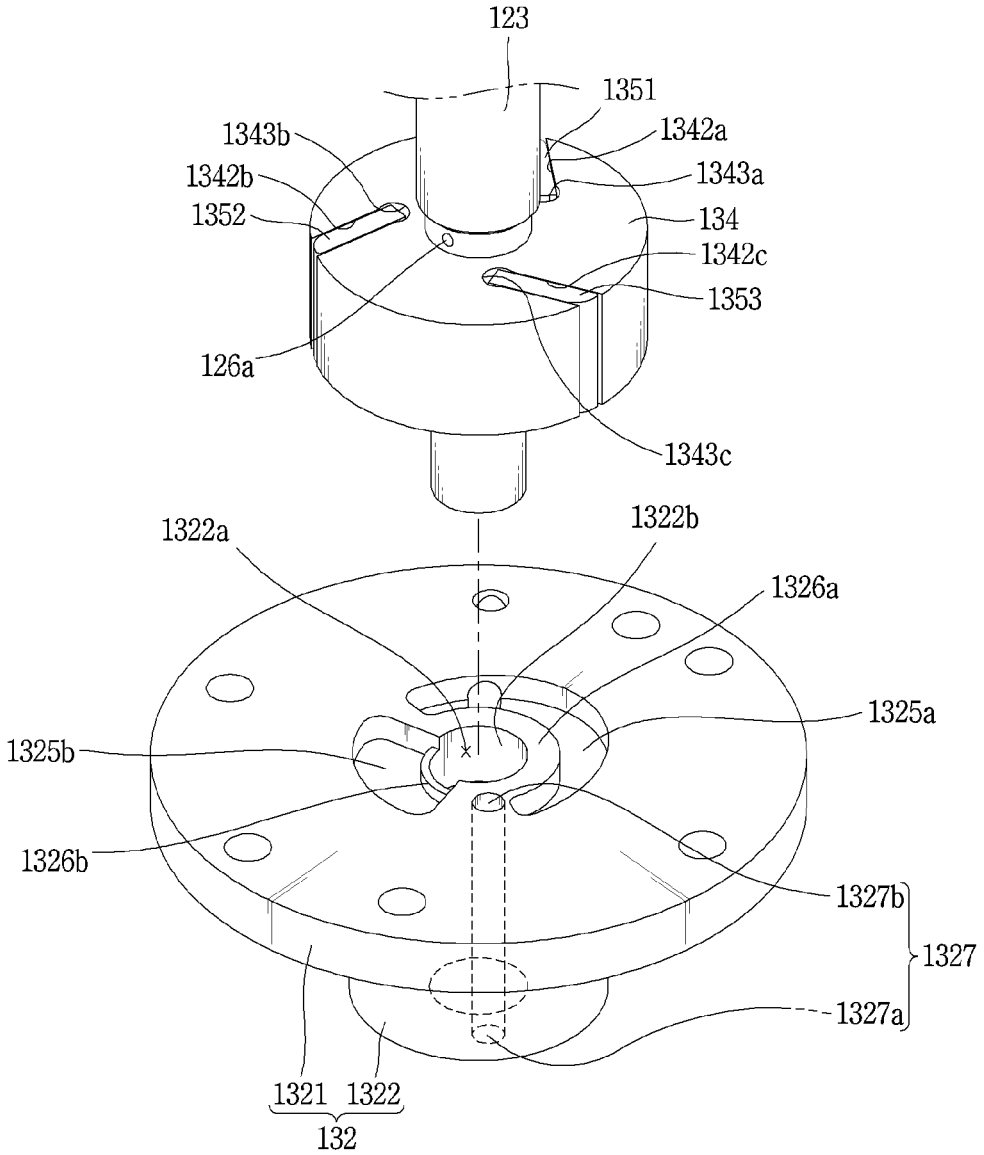
FIG. 4 is an exploded perspective view illustrating a portion of the compression unit in FIG. 1, viewed from the top.
Figure 5:
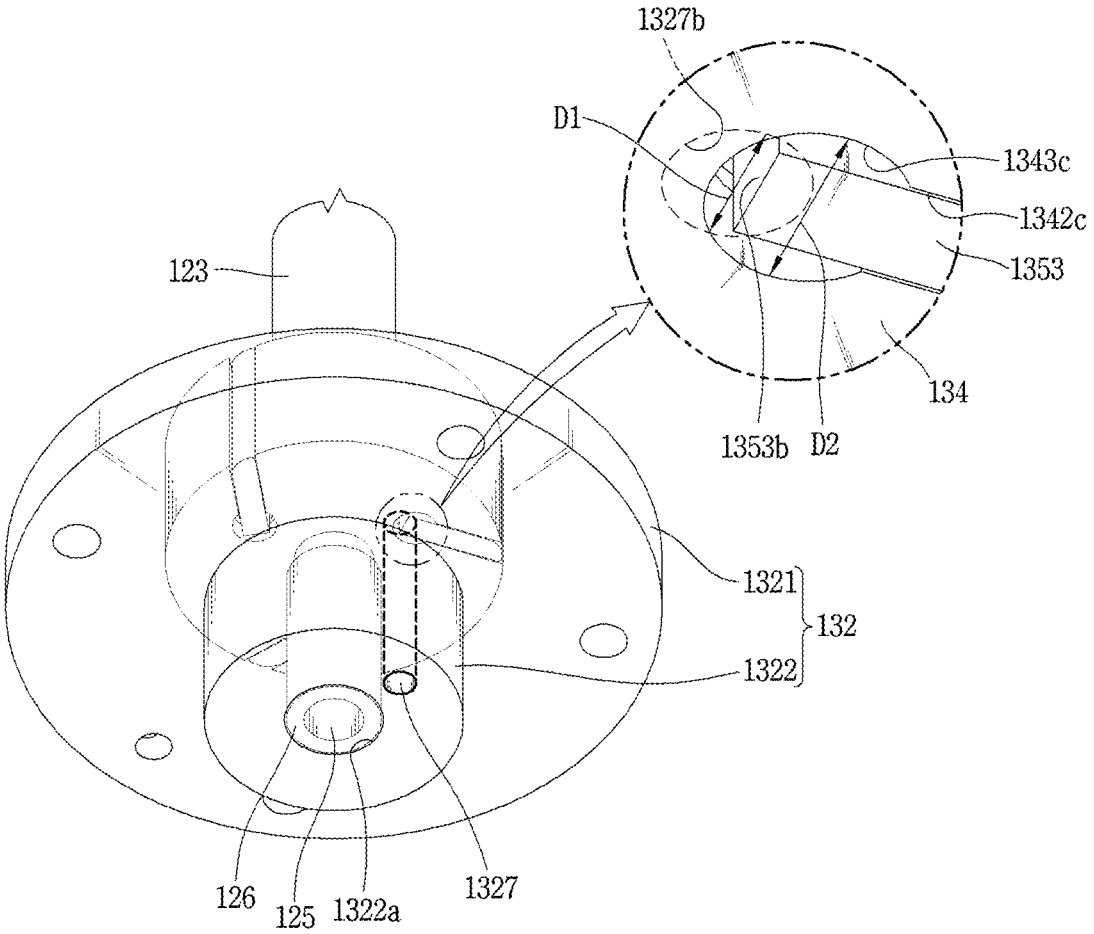
FIG. 5 is an assembled perspective view illustrating the portion of the compression unit in FIG. 4, viewed from the bottom.
Figure 6:
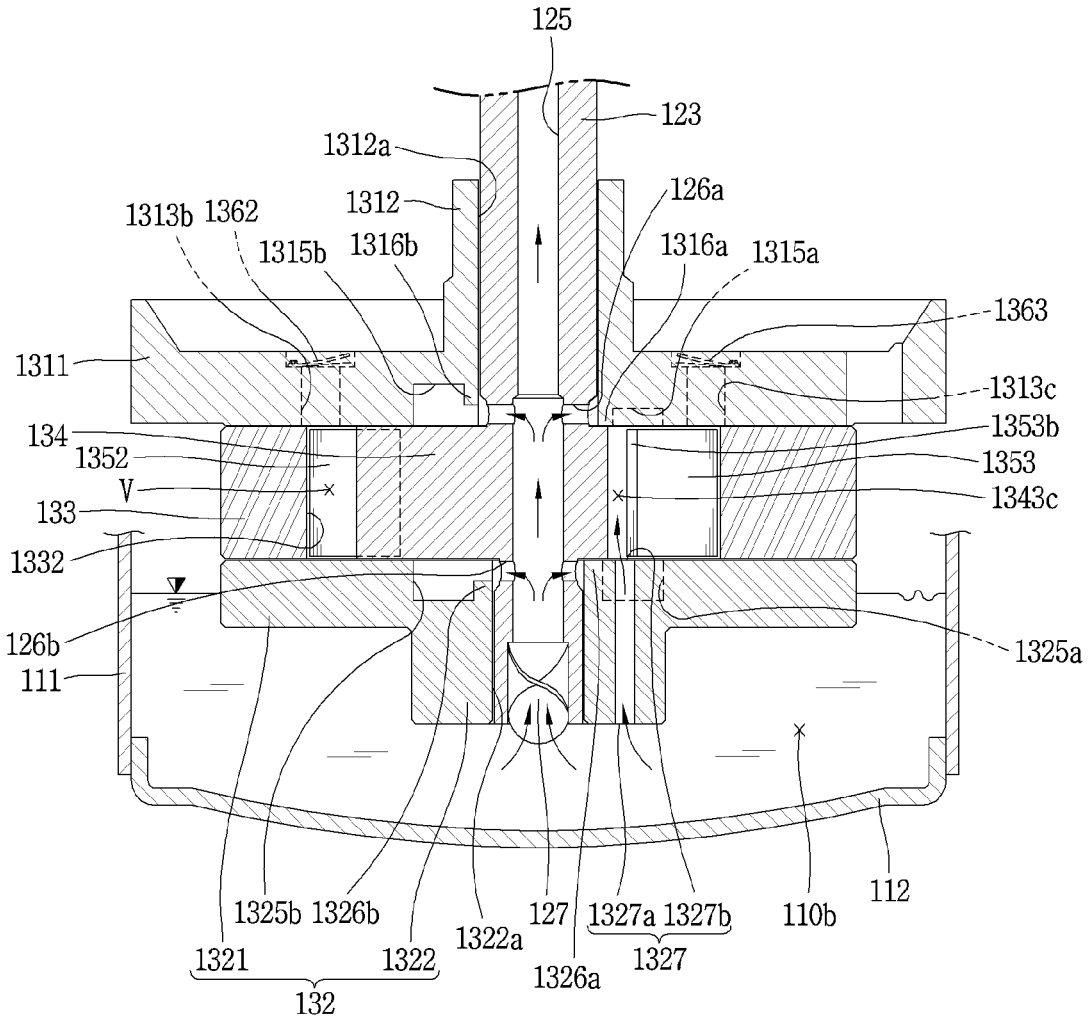
FIG. 6 is an assembled cross-sectional view of the compression unit in FIG. 1.
Figure 7:
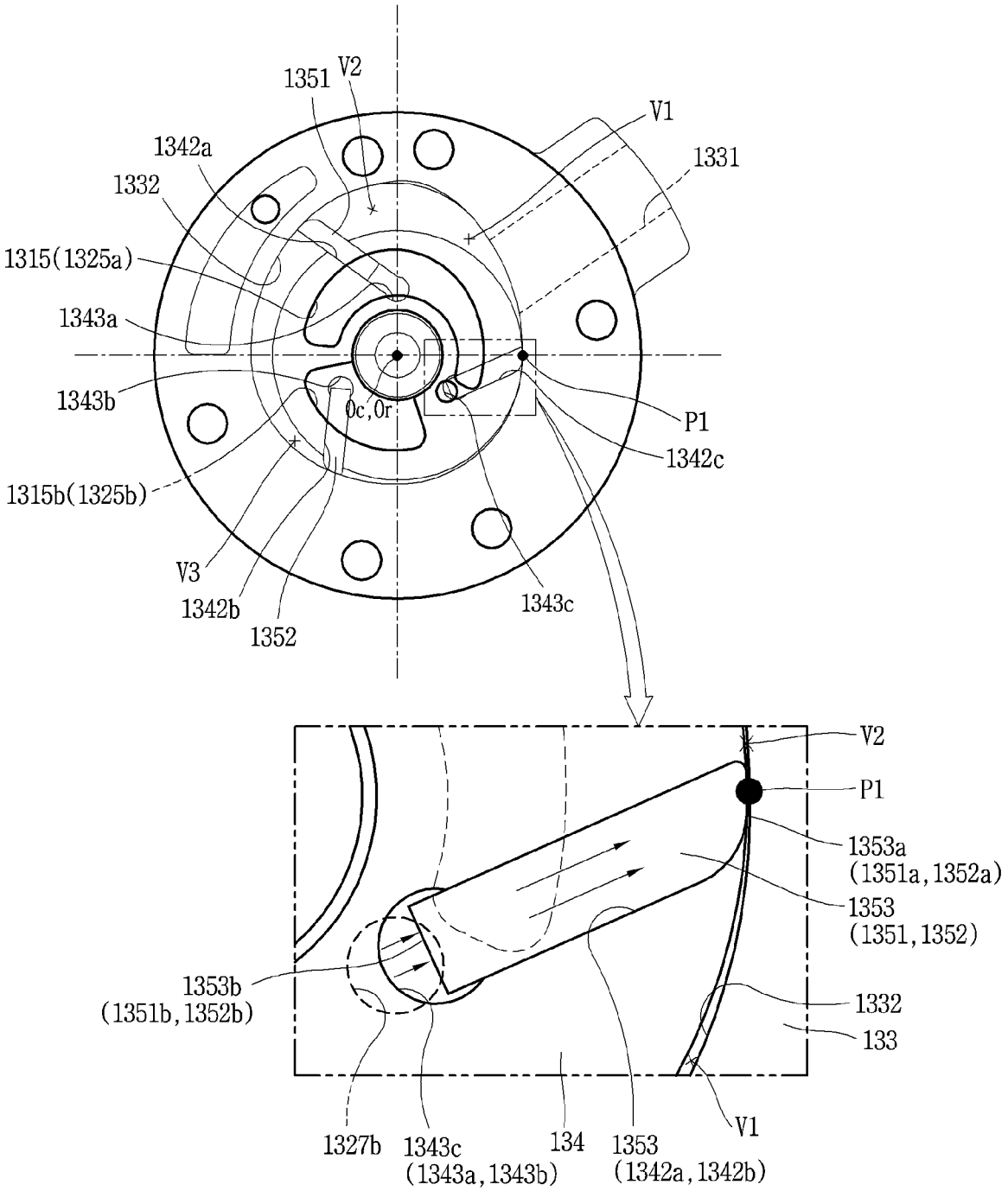
FIG. 7 is a schematic view for explaining an effect of an oil supply hole in FIG. 1.

FIG. 4 is an exploded perspective view illustrating a portion of the compression unit in FIG. 1, viewed from the top. FIG. 5 is an assembled perspective view illustrating the portion of the compression unit in FIG. 4, viewed from the bottom. FIG. 6 is an assembled cross-sectional view of the compression unit in FIG. 1, and FIG. 7 is a schematic view for explaining an effect of an oil supply hole in FIG. 1.

Referring back to FIG. 3, the sub bearing 132 according to this embodiment includes the sub plate portion 1321 and the sub bush portion 1322 as described above. The sub plate portion 1321 is formed in an annular disc shape, and the sub bush portion 1322 is formed in a cylindrical shape extending from a central area of the sub plate portion 1321 toward the oil storage space 110*b*.

On one surface of the sub plate portion 1321, that is, on an upper surface facing the roller 134, the first sub back pressure pocket 1325*a* and the second sub back pressure pocket 1325*b* having a different pressure are disposed along the circumferential direction at a preset or predetermined interval.

The first sub back pressure pocket 1325*a* communicates with the first main back pressure pocket 1315*a* of the main bearing 131 through the back pressure chamber 1343*a*, 1343*b*, 1343*c*, and the second sub back pressure pocket 1325*b* communicates with the second main back pressure pocket 1315*b* of the main bearing 131 through the back pressure chamber 1343*a*, 1343*b*, 1343*c*. In other words, the first sub back pressure pocket 1325*a* and the second sub back pressure pocket 1325*b* are located on an imaginary circle C connecting the respective back pressure chambers 1343*a*, 1343*b*, and 1343*c*. Accordingly, the first back pressure pocket 1315*a*, 1325*a* and the second back pressure pocket 1315*b*, 1325*b* may alternately communicate with the respective back pressure chambers 1343*a*, 1343*b*, and 1343*c* when the roller 134 rotates. Therefore, outlet 1327*b* of oil supply hole 1327, which will be described hereinafter, is formed to be located between the first sub back pressure pocket 1325*a* and the second sub back pressure pocket 1325*b*, and more specifically, located on the imaginary circle C connecting the respective back pressure chambers 1343*a*, 1343*b*, and 1343*c*.

Referring to FIGS. 4 to 7, the sub bush portion 1322 according to this embodiment may be formed such that its lower end surface extends toward a bottom surface of the oil storage space 110*b*, namely, a bottom surface of the lower shell 112. A sub bearing hole 1322*a* may be formed in a central area of the sub bush portion 1322, and an oil groove (shown in FIG. 5) 1322*c* may be formed in an inner circumferential surface of the sub bearing hole 1322*a*.

The oil supply hole 1327 may be formed through from a lower end surface of the sub bush portion 1322 to an upper surface of the sub plate portion 1321. For example, the oil supply hole 1327 may be formed through between the lower end surface of the sub bush portion 1322 and the upper surface of the sub plate portion 1321.

As described above, the inlet 1327*a* defining the first end of the oil supply hole 1327 may be formed through the lower end surface of the sub bush portion 1322. Accordingly, the lower end of the oil supply hole 1327 may be disposed deep in the oil storage space 110*b*, so that oil in the oil storage space 110*b* may be stably supplied to the rear end surface 1351*b*, 1352*b*, 1353*b* of the vane 1351, 1352, 1353 even during abnormal operation.

However, the lower end defining the inlet 1327*a* of the oil supply hole 1327 may alternatively be formed through an outer circumferential surface of the sub bush portion 1322. In other words, the inlet 1327*a* of the oil supply hole 1327 may be formed at any position as long as it is submerged in the oil of the oil storage space 110*b*.

The outlet 1327*b* of the oil supply hole 1327 may be formed between the first sub back pressure pocket 1325*a* and the second sub back pressure pocket 1325*b*. More specifically, the outlet 1327*b* of the oil supply hole 1327 may be located at a position where it communicates with a rear side of the vane slot 1342*a*, 1342*b*, 1342*c*, into which the vane 1351, 1352, 1353 is inserted, that is, with the corresponding back pressure chamber 1343*a*, 1343*b*, 1343*c* at a position where the front end surface 1351*a*, 1352*a*, 1353*a* of the corresponding vane 1351, 1352, 1353 passes through a fluctuation section α between the proximal point P1 and the suction port 1331. The fluctuation range a may be defined within a range of approximately 300° to 350° when the proximal point P1 is 0° in terms of a crank angle.

An inner diameter D1 of the oil supply hole 1327 may be formed to be approximately equal to an inner diameter D2 of the back pressure chamber 1343*a*, 1343*b*, 1343*c* or smaller than the inner diameter D2 of the back pressure chamber 1343*a*, 1343*b*, 1343*c*. For example, the inner diameter D1 of the oil supply hole 1327 may be equally maintained from the inlet 1327*a* to the outlet 1327*b* of the oil supply hole 1327, and may be equal to or smaller than the inner diameter D2 of the back pressure chamber 1343*a*, 1343*b*, 1343*c* at the outlet 1327*b* of the oil supply hole 1327. Accordingly, the oil supply hole 1327 may be formed in the sub bush portion 1322 while maintaining the outer diameter of the sub bush portion 1322.

As described above, when the oil supply hole 1327 directly communicating with the oil storage space 110*b* is formed between the first sub back pressure pocket 1325*a* and the second sub back pressure pocket 1325*b*, high-pressure oil may be supplied to the rear end surface 1351*b*, 1352*b*, 1353*b* of the vane 1351 5352, 1353 when the vane 1351, 1352, 1353 passes through the fluctuation section α between the proximal point P1 and the suction port 1331. This may result in suppressing trembling of the vane due to insufficient back pressure.

In other words, a separation section β spaced by a preset or predetermined gap is generated between a rear end of the second sub back pressure pocket 1325*b*, which forms a discharge pressure or an intermediate pressure close to the discharge pressure, and a front end of the first sub back pressure pocket 1325*a*, which faces the rear end and forms an intermediate pressure lower than the discharge pressure, based on the rotational direction of the roller 134. This separation section β generates the fluctuation section α described above or aggravates the trembling or vibration of the vane 1351, 1352, 1353.

In the separation section β, the front end surface 1351*a*, 1352*a*, 1353*a* of the vane 1351, 1352, 1353 unstably receives a suction pressure from the rotational direction and a discharge pressure from an opposite side to the rotational direction. At this time, the rear end surface 1351*b*, 1352*b*, 1353*b* of the vane 1351, 1352, 1353 is in a state passed through the separation section β and accordingly receives a back pressure lower than the discharge pressure. Accordingly, a backward pressure applied to the front end surface 1351*a*, 1352*a*, 1353*a* of the vane 1351, 1352, 1353 cannot be sufficiently suppressed. As a result, the vane 1351, 1352, 1353 may be pushed toward the back pressure chamber 1343*a*, 1343*b*, 1343*c*, and then pushed toward the inner circumferential surface 1332 of the cylinder 133. As this process is repeated, the vane 1351, 1352, 1353 may tremble or vibrate.

However, in this embodiment, the oil supply hole 1327 communicating with the oil storage space 110*b* may be formed in the separation section β, such that high-pressure oil may be supplied to the back pressure chamber 1343*a*, 1343*b*, 1343*c* in the separation section β. With this structure, when the vane 1351, 1352, 1353 passes between the proximal point P1 and the suction port 1331, the high-pressure oil may be supplied to the rear end surface 1351*b*, 1352*b*, 1353*b* of the vane 1351, 1352, 1353, so as to increase back pressure, thereby suppressing trembling of the vane 1351, 1352, 1353.

In addition, both ends of the oil supply hole 1327 according to this embodiment allow the oil storage space 110*b* and the back pressure chamber 1343*a*, 1343*b*, 1343*c* to directly communicate with each other. Accordingly, when the compressor is restarted, the oil in the oil storage space 110*b* may be quickly supplied to the back pressure chamber 1343*a*, 1343*b*, 1343*c*. This may effectively suppress the trembling of the vane 1351, 1352, 1353 which occurs when the compressor is restarted.

Figure 8A:
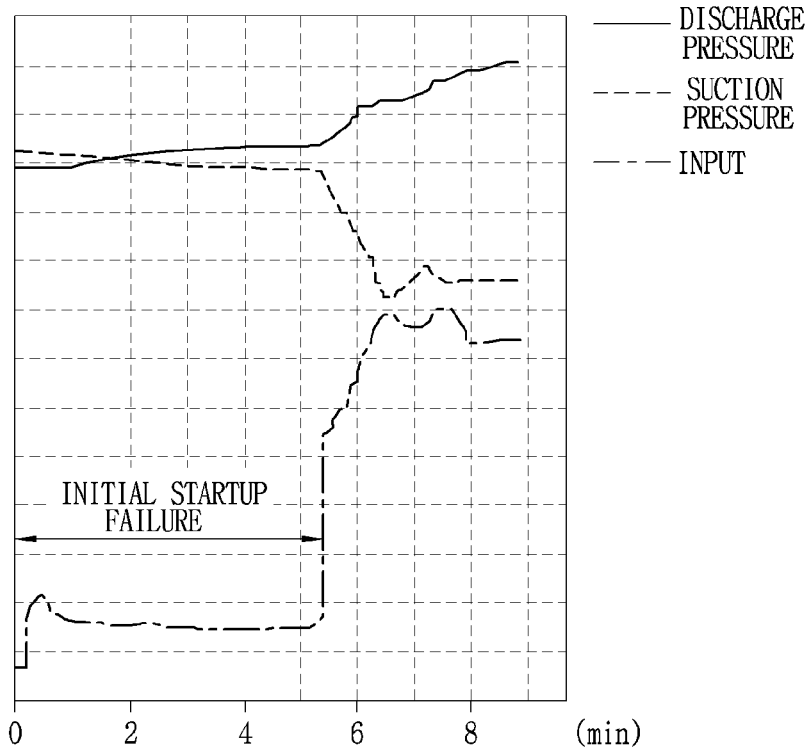
FIGS. 8A-8B are graphs for comparing effects of the oil supply hole according to FIG. 1 with the related art, where
Figure 8B:
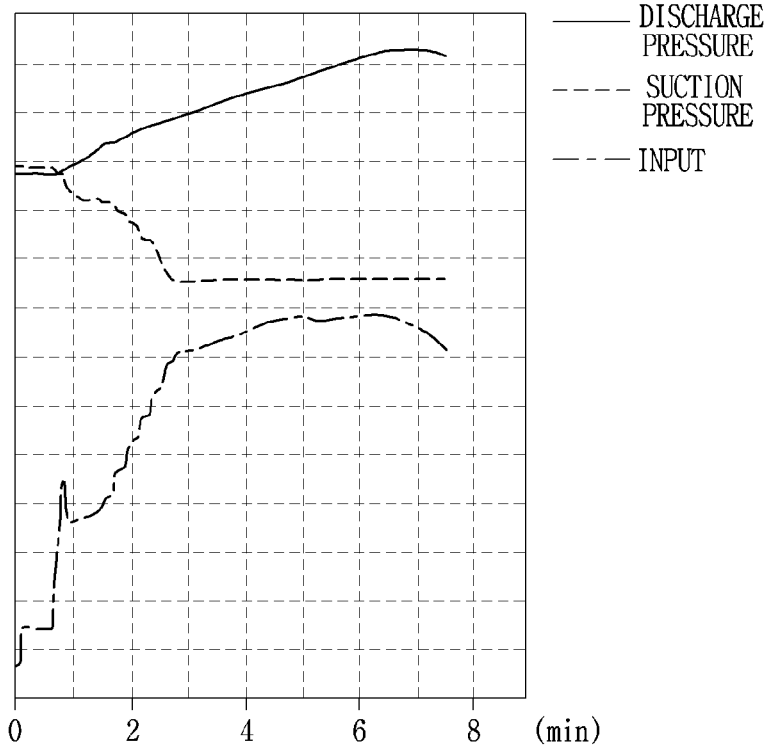

FIGS. 8A-8B are graphs for comparing effects of the oil supply hole according to FIG. 1 with the related art, where FIG. 8A illustrates the related art, and FIG. 8B illustrates an embodiment.

Referring to FIGS. 8A-8B, in the case of having the oil supply hole as in this embodiment, it can be seen that initial start-up time and compression forming time are shortened compared to the related art rotary compressor without an oil supply hole. Referring to FIG. 8A, it can be seen in the related art that a suction pressure formation and a discharge pressure formation are delayed for 5 minutes or more. The delay of the formation of the suction pressure and the formation of the discharge pressure results from pressure leakage between both compression chambers (suction chamber and discharge chamber) continuing due to the trembling phenomenon of the vane passing through the proximal point.

On the other hand, referring to FIG. 8B, it can be seen in the case of the embodiment that the suction pressure and the discharge pressure begin to be formed within about 1 minute, compared to the related art. Such quick start and completion of the suction pressure formation and the discharge pressure formation results from improvement in the trembling of the vane passing through the proximal point and reduction of pressure leakage between the compression chambers (suction chamber and discharge chamber).

In addition, referring to FIG. 8A, it can be seen in the related art that an input suddenly increases about 5 minutes after the start of operation. It can be understood that the initial start-up is made approximately 5 minutes after the start of operation. As a result, in the related art, the initial startup becomes poor.

On the other hand, referring to FIG. 8B, in the case of the embodiment, it can be seen that the initial startup is made more quickly than in the related art, considering that the input increases within only 30 seconds after the start of operation.

Accordingly, in the rotary compressor according to the embodiment, the trembling phenomenon that the vane is spaced apart from and then brought into contact with the cylinder during operation due to a pressure difference between the front end surface and the rear end surface of the vane may be suppressed. In particular, the trembling of the vane which may occur more severely upon the initial startup of the compressor may be effectively suppressed, which may prevent a defective initial startup, thereby enhancing efficiency of the compressor. In addition, when it is applied to an air conditioning device, air conditioning effects may be quickly exhibited.

In the rotary compressor according to the embodiment, the trembling of the vane in the vicinity of the proximal point may also be suppressed, thereby preventing wear of the inner circumferential surface of the cylinder or the front end surface of the vane in the vicinity of the proximal point. With this structure, vibration noise in a specific area may be decreased and leakage between compression chambers may be suppressed, thereby enhancing compression efficiency.

In addition, in the rotary compressor according to the embodiment, the pressure of the oil supplied to the rear end surface of the vane may be made uniform, suppressing pressure pulsation at the rear end surface of the vane. With this structure, the back pressure formed on the rear end surface of the vane may become constant, thereby more effectively suppressing the trembling of the vane.

Those effects described above may be more expected in the rotary compressor according to the embodiment when a high-pressure refrigerant, such as R32, R410a, or $CO_2$ is used.

Hereinafter, description will be given of an oil supply hole according to another embodiment. That is, in the previous embodiment, the inner diameter of the oil supply hole is formed equally along the longitudinal direction, but depending on cases, the inner diameter of the oil supply hole may vary along the longitudinal direction.

Figure 9:
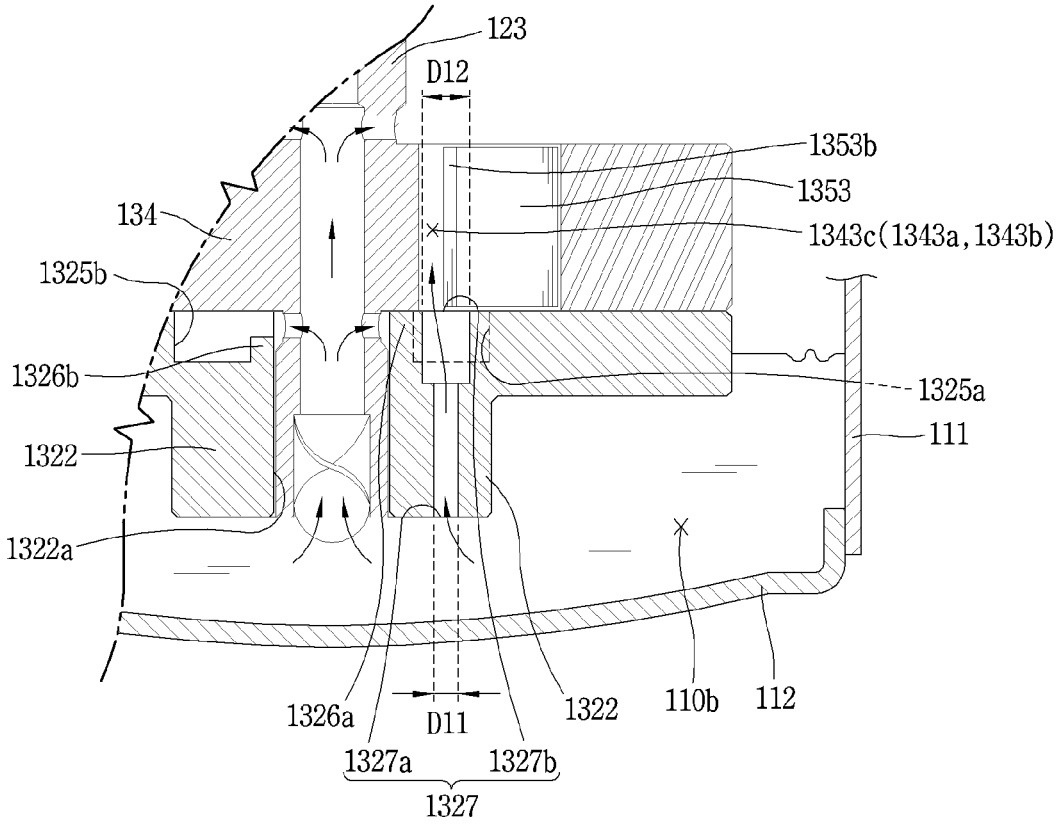
FIG. 9 is a cross-sectional view of an oil supply hole in FIG. 1 according to another embodiment.

FIG. 9 is a cross-sectional view of an oil supply hole in FIG. 1 according to another embodiment. Referring to FIG. 9, the oil supply hole 1327 according to this embodiment may have a different inner diameter D1 along the longitudinal direction. For example, the oil supply hole 1327 may be formed such that an inner diameter D12 of an upper-half portion defining the outlet 1327*b* is larger than an inner diameter D11 of a lower-half portion defining the inlet 1327*a*.

More specifically, the oil supply hole 1327 has the first inner diameter D11 from a lower end (inlet end) defining the inlet 1327*a* to a middle portion, and the second inner diameter D12 from the middle portion to an upper end (outlet end) defining the outlet 1327*b*. The second inner diameter D12 may be larger than the first inner diameter D11.

Although not shown in the drawing, the inner circumferential surface of the oil supply hole 1327 may be formed in an elliptical or rectangular shape rather than a circular shape. In this case, a cross-sectional area of the upper-half portion defining the outlet 1327*b* may be larger than a cross-sectional area of the lower-half portion defining the inlet 1327*a*.

As described above, the inner diameters D11 and D12 (or cross-sectional areas) of the oil supply hole 1327 are different along the longitudinal direction. However, when the inner diameter D11 (or cross-sectional area) of the lower-half portion defining the inlet 1327*a* is larger than the inner diameter D12 (or a cross-sectional area) of the upper-half portion defining the outlet 1327*b*, a volume of the upper-half portion close to the back pressure chamber 1343*a*, 1343*b*, 1343*c* is relatively larger. Accordingly, a differential pressure is generated inside of the oil supply hole 1327, so that the oil in the oil storage space 110*b* may move more quickly toward the back pressure chamber 1343*a*, 1343*b*, 1343*c* along the oil supply hole 1327.

Hereinafter, description will be given of an oil supply hole according to another embodiment. That is, in the previous embodiment, the oil supply hole is formed to be spaced apart from both back pressure pockets, but in some cases, the oil supply hole may be formed to communicate with either one of the both back pressure pockets.

Figure 10:
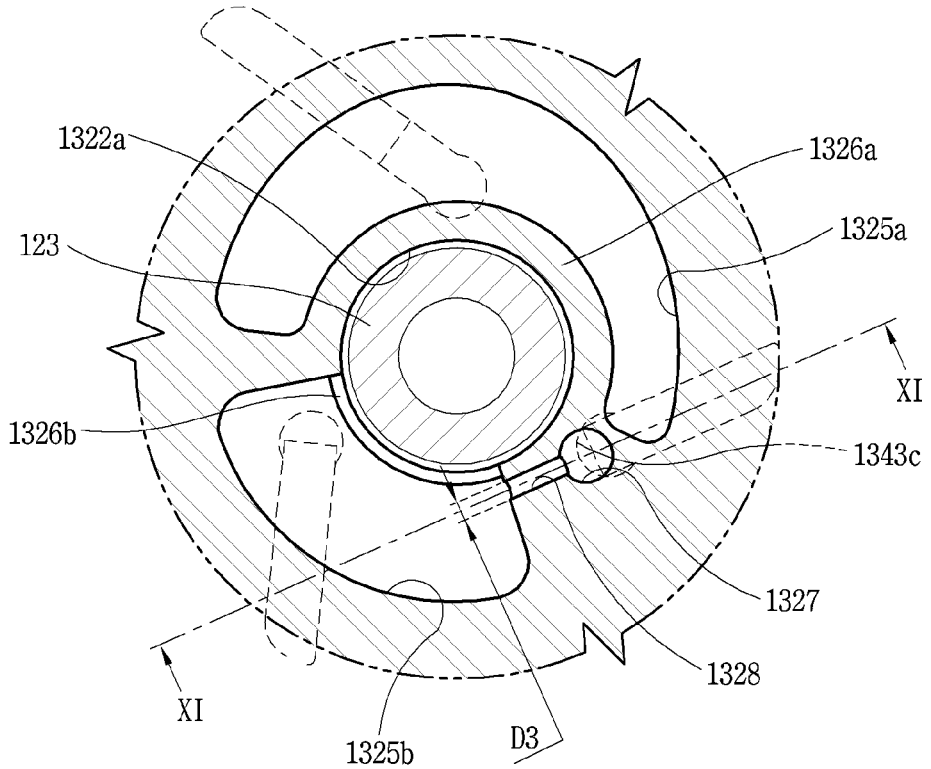
FIG. 10 is a cross-sectional view of an oil supply hole in FIG. 1 according to still another embodiment.
Figure 11:
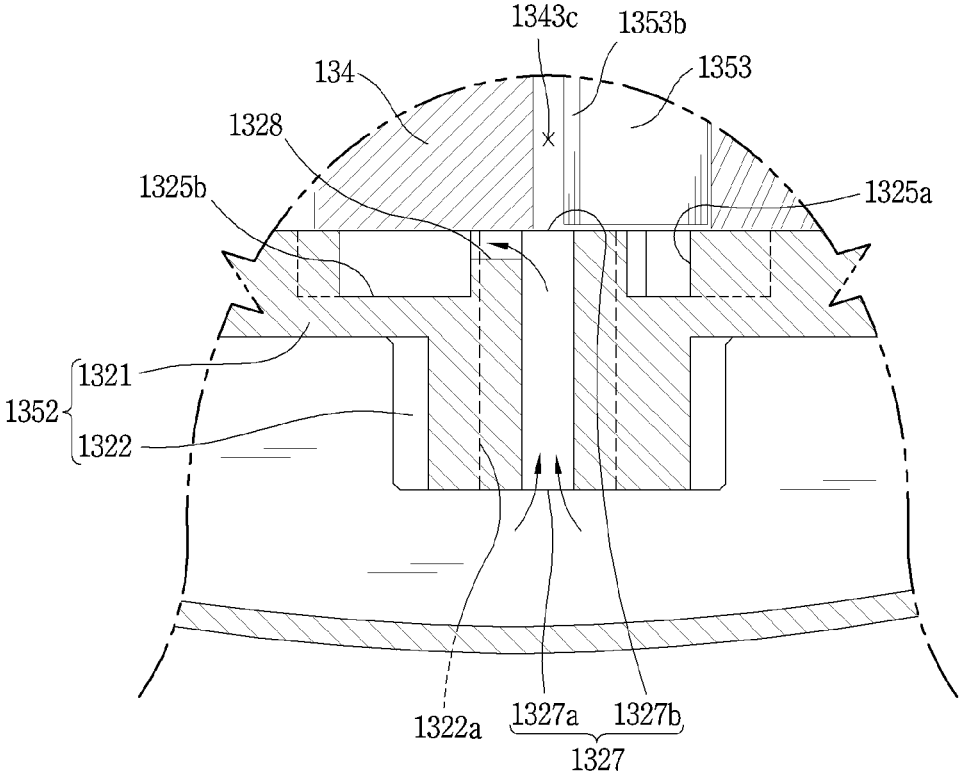
FIG. 11 is a cross-sectional view, taken along line "XI-XI" of FIG. 10.

FIG. 10 is a cross-sectional view of an oil supply hole in FIG. 1 according to still another embodiment. FIG. 11 is a cross-sectional view, taken along line "XI-XI" of FIG. 10.

Referring to FIGS. 10 and 11, the oil supply hole 1327 according to this embodiment may be formed to be substantially similar to those of the previous embodiments. For example, the oil supply hole 1327 may be formed through the sub bush portion 1322, but may be formed such that an upper end defining the outlet 1327*b* is located between the rear end of the second sub back pressure pocket 1325*b* and the front end of the first sub back pressure pocket 1325*a*.

In this case, the oil supply hole 1327 may have the inner diameter D1 which is constant or may be formed such that an inner diameter of the upper-half portion defining the outlet 1327*b* is larger than an inner diameter of the lower-half portion defining the inlet 1327*a*. In this embodiment, the case where the oil supply hole 1327 has the same (constant) inner diameter D1 will be described as an example.

However, in this embodiment, a communication groove 1328 may further be disposed between a side surface of the rear end of the second sub back pressure pocket 1325*b* and a side surface of an upper end of the oil supply hole 1327 facing the side surface of the rear end, based on the rotational direction of the roller 134. Accordingly, the oil supply hole 1327 may communicate with the second sub back pressure pocket 1325*b* through the communication groove 1328.

A width D3 of the communication groove 1328 may be the same as the inner diameter D1 of the oil supply hole 1327. In this case, a communication area between the second sub back pressure pocket 1325*b* and the oil supply hole 1327 may be widened, so that oil may actively flow between the second back pressure pocket and the oil supply hole 1327. For example, oil suctioned through the oil supply hole 1327 may quickly move to the second sub back pressure pocket 1325*b*.

On the other hand, as shown in FIG. 10, the width D3 of the communication groove 1328 may be smaller than the inner diameter D1 of the oil supply hole 1327. In this case, the communication groove 1328 forms a kind of venturi tube between the oil supply hole 1327 and the second sub back pressure pocket 1325*b*, so that the oil in the oil storage space 110*b* may flow into the oil supply hole 1327 more quickly. The oil may quickly move to the second sub back pressure pocket 1325*b*, so that oil shortage in the second sub back pressure chamber 1343*a*, 1343*b*, 1343*c* may be eliminated when the compressor is restarted.

Hereinafter, description will be given of an oil supply hole according to another embodiment. That is, in the previous embodiment, the oil supply hole is formed through the sub bush portion, but in some cases, the oil supply hole may be formed through the sub plate portion.

Figure 12:
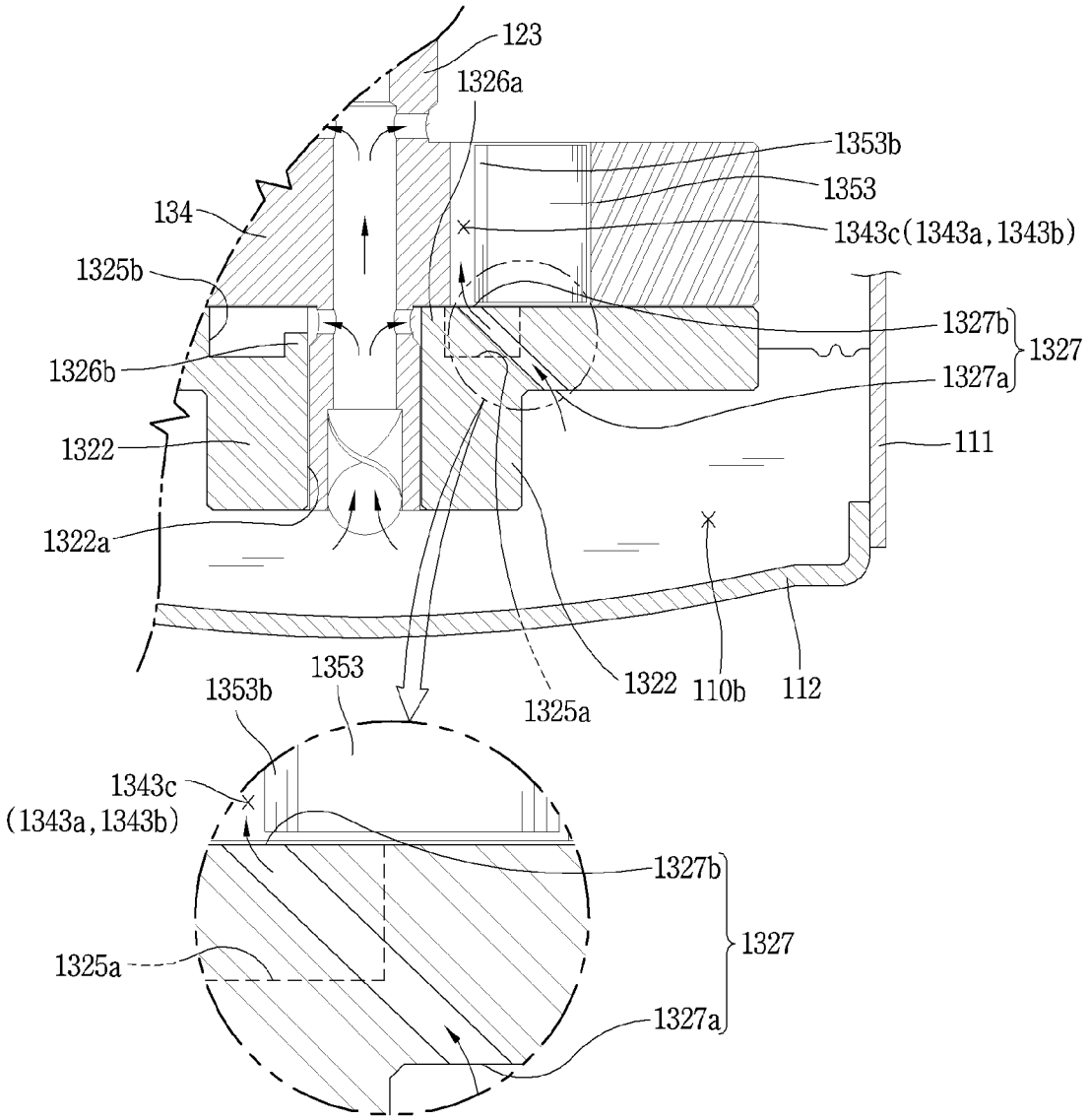
FIG. 12 is a cross-sectional view of an oil supply hole in FIG. 1 according still another embodiment.
Figure 13:
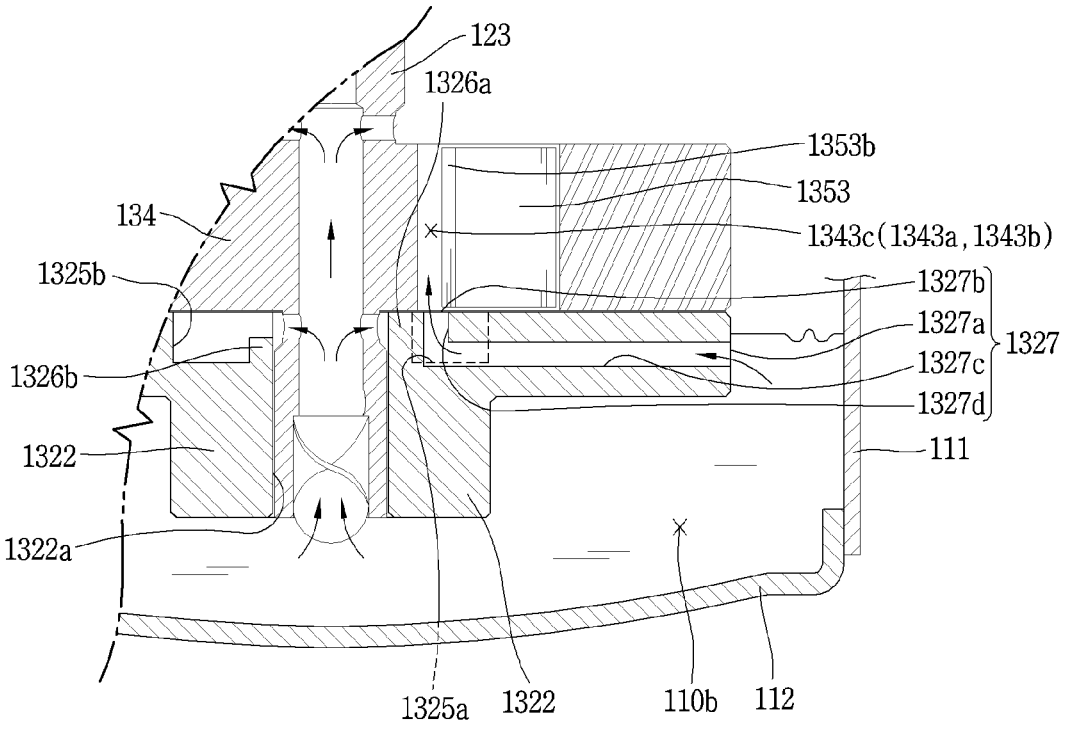
FIG. 13 is a cross-sectional view of an oil supply hole in FIG. 1 according to still another embodiment.

FIG. 12 is a cross-sectional view of an oil supply hole in FIG. 1 according to still another embodiment. FIG. 13 is a cross-sectional view of an oil supply hole in FIG. 1 according to still another embodiment.

Referring to FIG. 12, the oil supply hole 1327 according to this embodiment may have a shape or a penetrating position similar to those of the previous embodiments. For example, the inner diameter D1 of the oil supply hole 1327 may be formed constantly or may be realized by a plurality of inner diameters along the longitudinal direction.

The outlet 1327*b* of the oil supply hole 1327 is formed between the rear end of the second sub back pressure pocket 1325*b* and the front end of the first sub back pressure pocket 1325*a*, and a communication groove 1328 may be further formed between the outlet 1327*b* of the oil supply hole 1327 and the rear end of the second sub back pressure pocket 1325*b* as in the embodiment illustrated in FIG. 10. As the operating effects thereof are the same as those in the previous embodiments, description thereof will be replaced with the description in the previous embodiments.

However, in this embodiment, the oil supply hole 1327 may be formed through the sub plate portion 1321 from the lower surface to the upper surface of the sub plate portion 1321. In this case, the inlet 1327*a* of the oil supply hole 1327 may be formed radially outward compared to the outlet 1327*b* of the oil supply hole 1327 in consideration of the outer diameter of the sub bush portion 1322. Accordingly, the oil supply hole 1327 may be inclined so that the outlet 1327*b* is closer to the rotary shaft 123.

As described above, when the oil supply hole 1327 is formed through the sub plate portion 1321, the length of the oil supply hole 1327 is shortened compared to the previous embodiments, and an oil supply path is shortened accordingly. With this structure, oil may be rapidly supplied to the back pressure chamber 1343*a*, 1343*b*, 1343*c* through the oil supply hole 1327.

The oil supply hole 1327 is formed through the sub plate portion 1321 and may be formed in a radial direction. Referring to FIG. 13, the oil supply hole 1327 may be formed through the sub plate portion 1321 from the outer circumferential surface to the upper surface of the sub plate portion 1321. For example, the oil supply hole 1327 may include a first hole portion 1327*c* formed by a preset or predetermined depth in the outer circumferential surface of the sub plate portion 1321, and a second hole portion 1327*d* formed through the upper surface of the sub plate portion 1321 from an inner end of the first hole portion 1327*c*.

The first hole portion 1327*c* and the second hole portion 1327*d* may have a same inner diameter, or an inner diameter of the first hole portion 1327*c* may be larger than an inner diameter of the second hole portion 1327*c*, considering that the first hole portion 1327*c* is formed long in length. In this case, a pressure reducing pin (not shown) may be inserted into the first hole portion 1327*c*.

An area of the second hole portion 1327*d* may be larger than an area of the first hole portion 1327*c* (an area of a groove excluding the pressure reducing pin). With this structure, the differential pressure generation effect described above may be enhanced.

As described above, when a portion of the oil supply hole 1327 is formed radially in the sub plate portion 1321, an overall length of the oil supply hole 1327 increases. However, as the first hole portion 1327*c* constituting the oil supply hole 1327 is formed in the radial direction, the first hole portion 1327*c* is always filled with a predetermined amount of oil. Then, the actual length of the oil supply hole 1327 corresponds to a length of the second hole portion 1327*d*, and thereby the length of the second hole portion 1327*d* is shorter than axial lengths of the oil supply holes 1327 in the previous embodiments. Accordingly, the length of the oil supply hole 1327 according to this embodiment is substantially shortened. Then, when the compressor is restarted, oil may be quickly supplied to the back pressure chamber 1343*a*, 1343*b*, 1343*c*.

Hereinafter, description will be given of an oil supply hole according to still another embodiment. That is, in the previous embodiments, the oil supply hole is formed outside of the sub bearing hole, but in some cases, the oil supply hole may be formed through the inner circumferential surface of the sub bearing hole.

Figure 14:
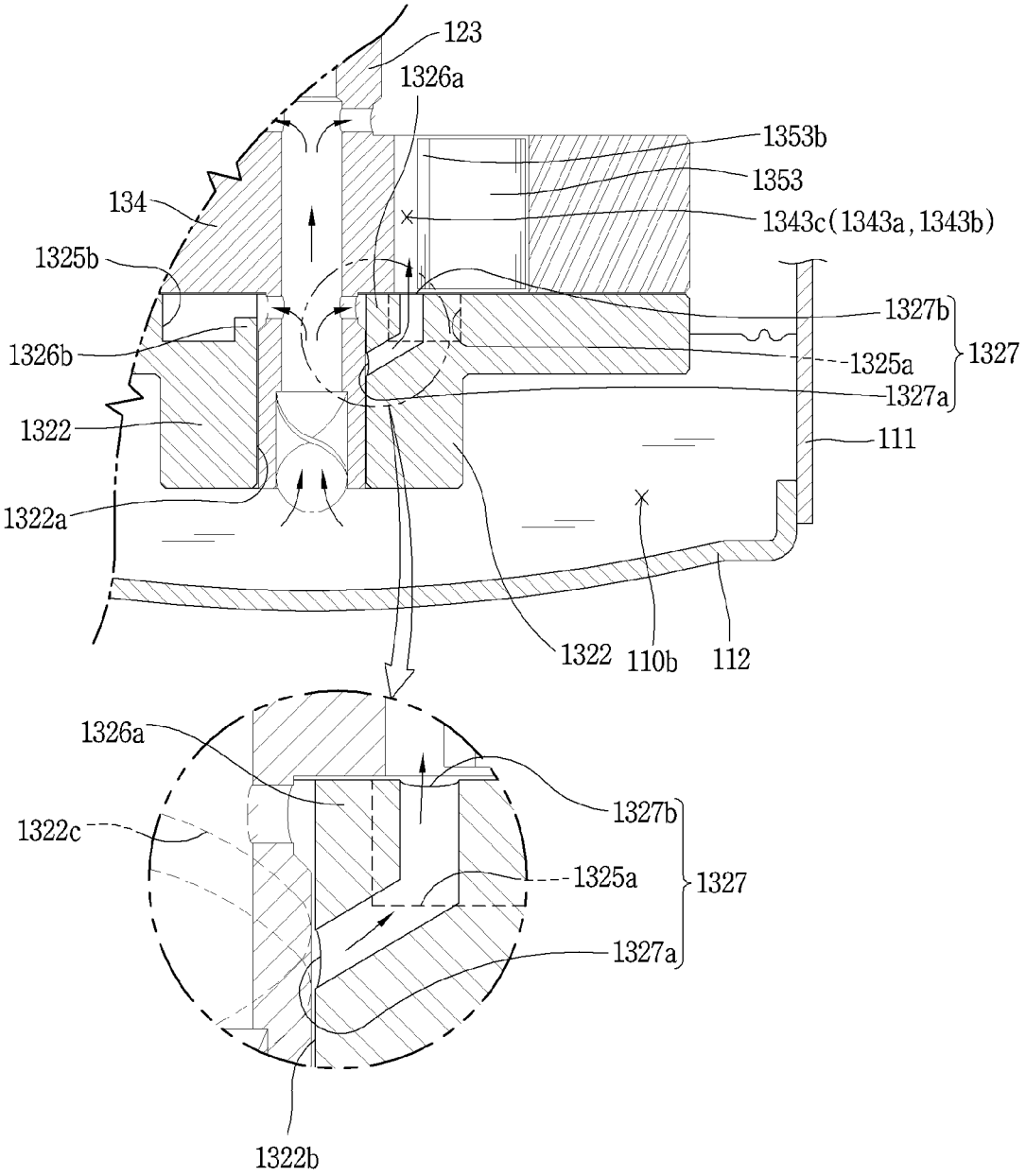
FIG. 14 is a cross-sectional view of an oil supply hole in FIG. 1 according to yet another embodiment.

FIG. 14 is a cross-sectional view of an oil supply hole in FIG. 1 according to another embodiment. Referring to FIG. 14, the oil supply hole 1327 according to this embodiment may be formed such that a lower end defining the inlet 1327*a* is formed through the inner circumferential surface of the sub bush portion 1322, that is, the sub bearing surface 1322*a* defining the inner circumferential surface of the sub bearing hole 1322*a*.

For example, the outlet 1327*b* of the oil supply hole 1327 may be formed in the upper surface of the sub plate portion 1321 as in the previous embodiments, but may be formed between the rear end of the second sub back pressure pocket 1325*b* and the front end of the first sub back pressure pocket 1325*a*. In this case, the oil supply hole 1327 may be formed to be spaced apart from the first sub back pressure pocket 1325*a* or the second sub back pressure pocket 1325*b*, or may be formed to communicate with the second sub back pressure pocket 1325*b* through the communication groove 1328 as in the embodiment of FIG. 10. As the configuration is similar to those in the previous embodiments, description thereof will be replaced with the description in the previous embodiments.

However, in this embodiment, the inlet 1327*a* of the oil supply hole 1327 may be formed through the inner circumferential surface of the sub bush portion 1322 defining the sub bearing surface 1322*b*. Accordingly, some of oil supplied to the sub bearing surface 1322*b* through the oil flow path 125 and the second oil passage hole 126*b* may be supplied to the back pressure chamber 1343*a*, 1343*b*, 1343*c* through the oil supply hole 1327.

In addition, in this embodiment, an oil groove 1322*c* is formed in a spiral shape in the sub bearing surface 1322*b*, and the inlet 1327*a* of the oil supply hole 1327 may be formed through the middle of the oil groove 1322*c*. In this case, when the rotary shaft 123 rotates, some of oil suctioned through the oil groove 132*c* by centrifugal force may flow into the oil supply hole 1327, and then may be quickly supplied to the back pressure chamber 1343*a*, 1343*b*, 1343*c* through the oil supply hole 1327. Accordingly, in this embodiment, oil may be more quickly supplied to the back pressure chamber 1343*a*, 1343*b*, 1343*c* so as to more stably support the vane 1351, 1352, 1353 while more effectively suppressing the trembling phenomenon that occurs when the compressor is restarted.

Hereinafter, description will be given of an oil supply hole according to still another embodiment. That is, in the previous embodiments, the inlet of the oil supply hole is exposed and communicates with the oil storage space, but in some cases, an oil pickup may be installed at the inlet of the oil supply hole.

Figure 15:
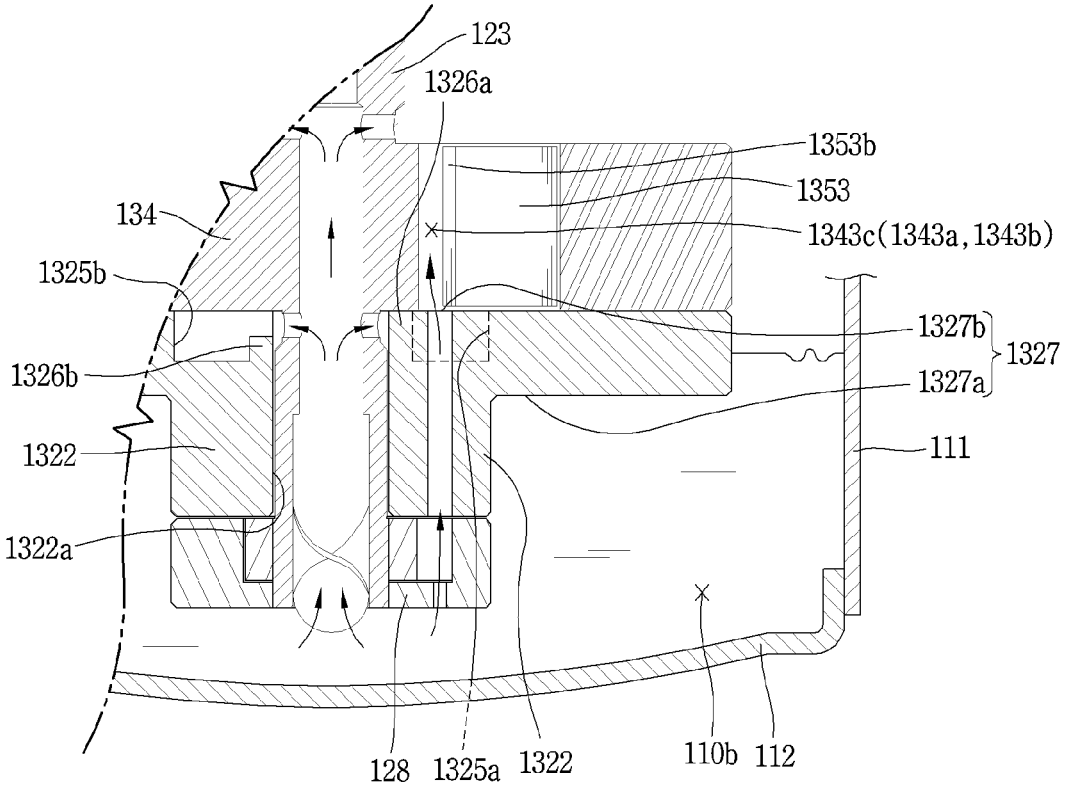
FIG. 15 is a cross-sectional view of an oil supply hole in FIG. 1 according to yet another embodiment.

FIG. 15 is a cross-sectional view of an oil supply hole in FIG. 1 according to still another embodiment. Referring to FIG. 15, an oil pump 128 may further be installed at the lower end of the rotary shaft 123 according to this embodiment, and the inlet 1327*a* of the oil supply hole 1327 may communicate with an outlet of the oil pump 128.

The oil pump 128 may be implemented by various pumps, such as a centrifugal pump, a viscous pump, or a displacement pump, for example. This embodiment describes an example in which a trochoid gear pump, which is a type of displacement pump, is applied.

The oil supply hole 1327 according to this embodiment may be applied to the oil supply hole 1327 according to the embodiment of FIG. 4. However, the lower end defining the inlet 1327*a* of the oil supply hole 1327 may be formed through the lower end surface of the sub bush portion 1322. As a shape and location of the oil supply hole 1327 are the same as those of the previous embodiment, description thereof is replaced with the description of the previous embodiment.

However, as in this embodiment, when the oil pump 128 is installed at the lower end of the rotary shaft 123 and the inlet 1327*a* of the oil supply hole 1327 is connected to the outlet of the oil pump 128, oil stored in the oil storage space 110*b* may be rapidly supplied to the back pressure chamber 1343*a*, 1343*b*, 1343*c*. Accordingly, oil may be quickly and effectively supplied to the back pressure chamber 1343*a*, 1343*b*, 1343*c* even when the compressor is restarted, thereby significantly reducing trembling of the vane 1351, 1352, 1353, as well as resulting noise and loss.

Hereinafter, description will be given of an oil supply hole according to another embodiment. That is, in the previous embodiments, the oil supply hole is formed through the sub bearing to periodically communicate with the back pressure chamber, but in some cases, the oil supply hole may be formed through the rotary shaft and the roller to always communicate with the back pressure chamber.

Figure 16:
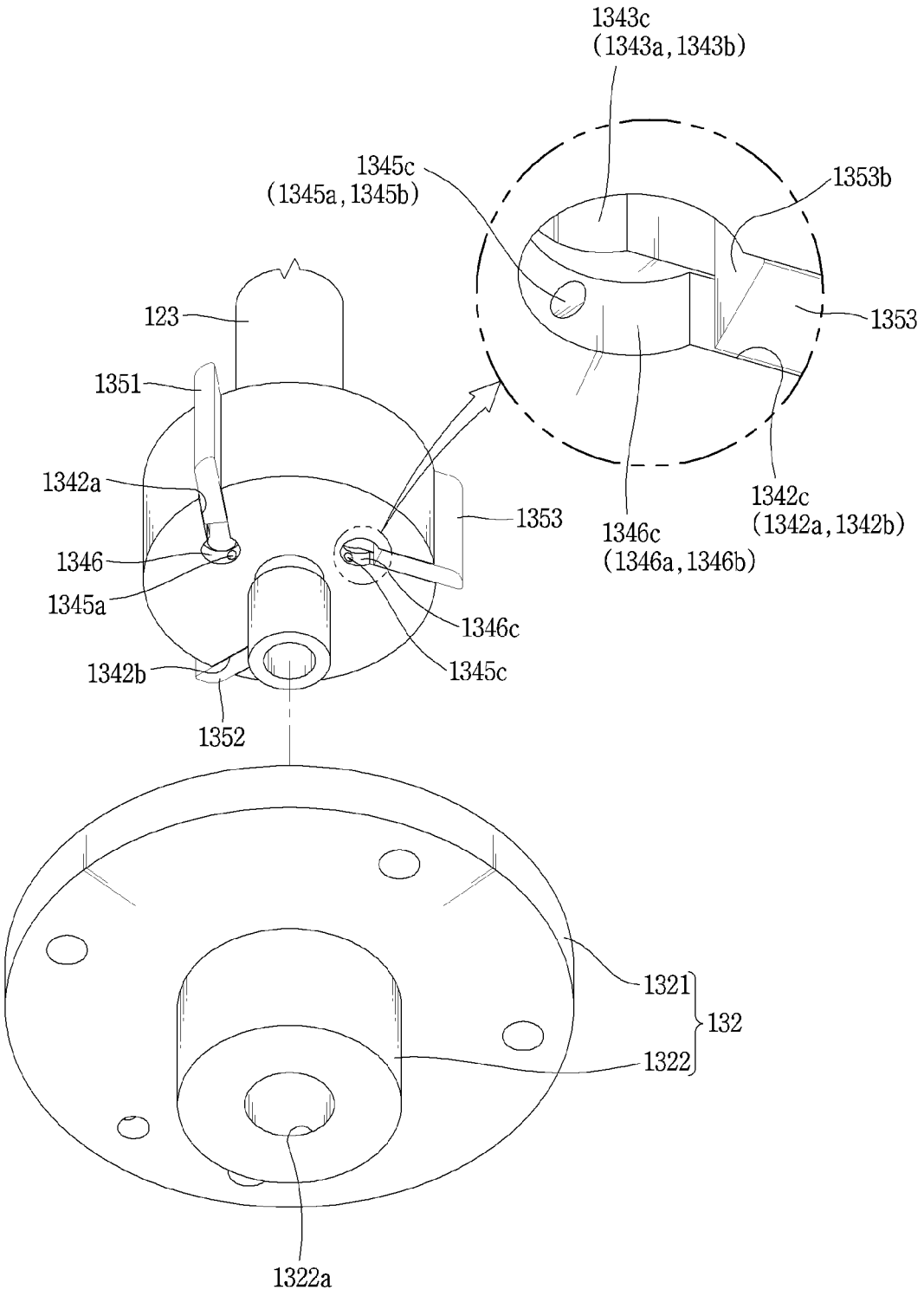
FIG. 16 is an exploded cross-sectional view illustrating a portion of a compression unit for explaining of an oil supply hole in FIG. 1 according to yet another embodiment.
Figure 17:
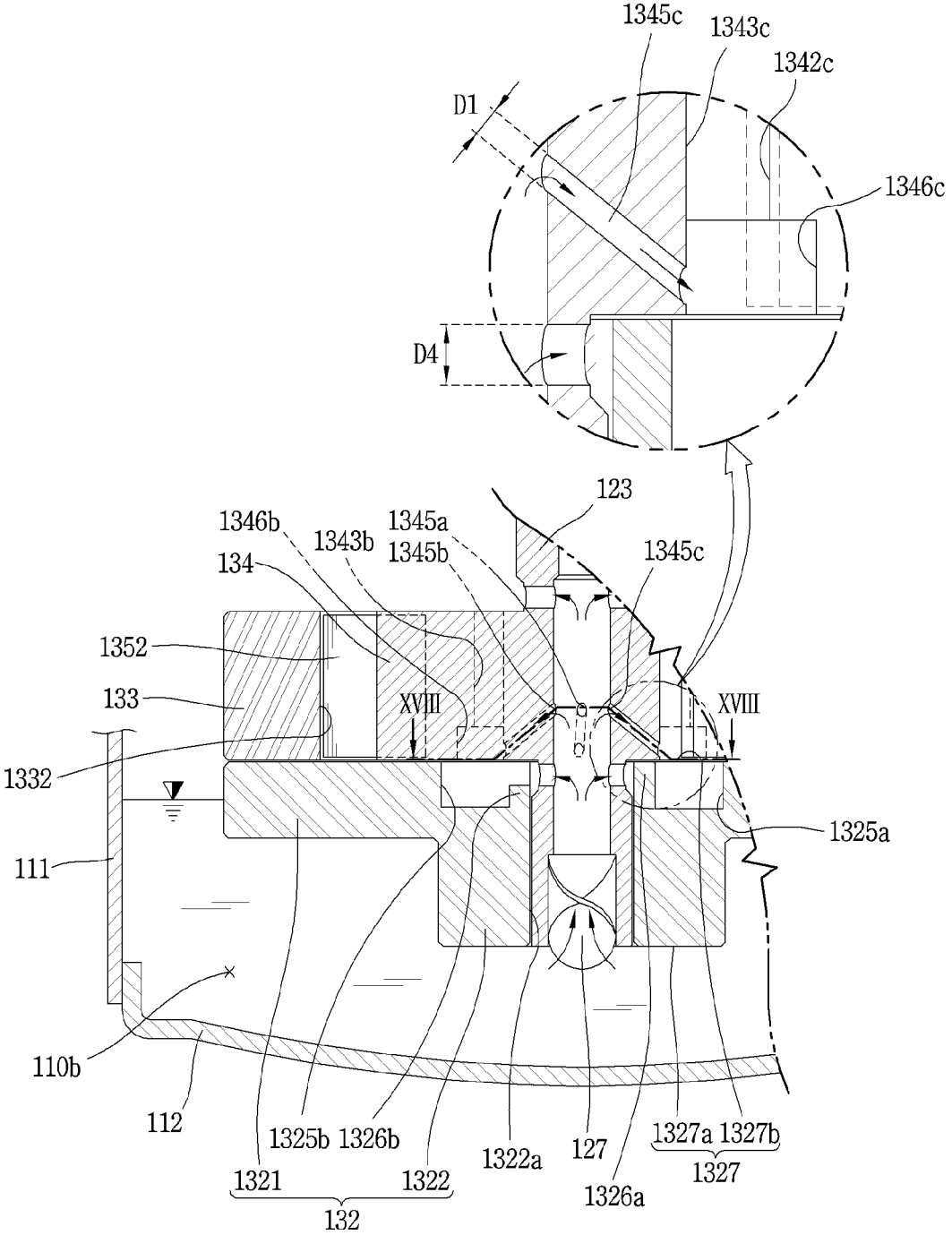
FIG. 17 is an assembled cross-sectional view illustrating a portion of the compression unit of FIG. 16.
Figure 18:
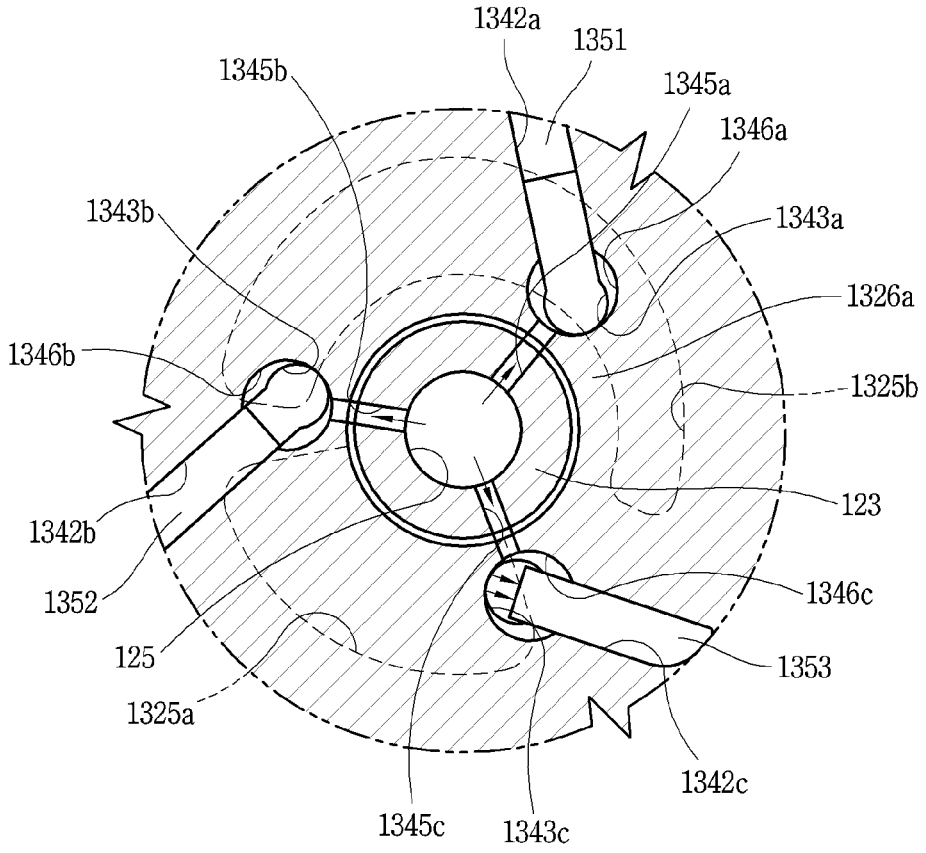
FIG. 18 is a planar view illustrating a portion of FIG. 17, which is a cross-sectional view, taken along line "XVIII-XVIII" in FIG. 17.

FIG. 16 is an exploded cross-sectional view illustrating a portion of a compression unit for explaining of an oil supply hole in FIG. 1 according to another embodiment, FIG. 17 is an assembled cross-sectional view illustrating a portion of the compression unit of FIG. 16, and FIG. 18 is a planar view illustrating a portion of FIG. 17, which is a cross-sectional view, taken along line "XVIII-XVIII".

Referring to FIGS. 16 to 18, the oil supply hole 1345*a*, 1345*b*, 1345*c* according to this embodiment is formed through between the oil flow path 125 of the rotary shaft 123 and the back pressure chamber 1343*a*, 1343*b*, 1343*c* of the roller 134.

For example, the oil supply hole 1345*a*, 1345*b*, 1345*c* according to this embodiment may be provided as a plurality, and the plurality of oil supply holes 1345*a*, 1345*b*, and 1345*c* may be formed through the inside of the roller 134 from a middle of the inner circumferential surface of the oil flow path 125, which penetrates through the inside of the rotary shaft 123, toward the respective vane slots 1342*a*, 1342*b*, and 1342*c* of the roller 134, more precisely, toward the respective back pressure chambers 1343*a*, 1343*b*, and 1343*c*.

The plurality of oil supply holes 1345*a*, 1345*b*, and 1345*c* may be disposed at equal distances along the circumferential direction at a same height. However, in some cases, the plurality of oil supply holes 1345*a*, 1345*b*, and 1345*c* may be formed at equal distances along the circumferential direction at different heights, or may be formed at different distances along the circumferential direction at the same height.

The plurality of oil supply holes 1345*a*, 1345*b*, and 1345*c* may be formed in the radial direction. However, considering that the outlets 1327*b* of the oil supply holes 1345*a*, 1345*b*, and 1345*c* are formed through inner circumferential surfaces of oil supply guide grooves 1346*a*, 1346*b*, and 1346*c* described hereinafter, the plurality of oil supply holes 1345*a*, 1345*b*, and 1345*c* may be inclined.

The plurality of oil supply holes 1345*a*, 1345*b*, and 1345*c* may be formed through the inner circumferential surfaces of the respective back pressure chambers 1343*a*, 1343*b*, and 1343*c*. However, as in this embodiment, the oil supply guide grooves 1346*a*, 1346*b*, and 1346*c* may be formed to communicate with the back pressure chambers 1343*a*, 1343*b*, and 1343*c*, respectively, and the oil supply holes 1345*a*, 1345*b*, 1345*c* may be formed through the respective oil supply guide grooves 1346*a*, 1346*b*, and 1346*c*. Accordingly, pulsating pressure of oil flowing into the back pressure chambers 1343*a*, 1343*b*, and 1343*c* may be reduced while maintaining an attitude angle when machining the oil supply holes 1345*a*, 1345*b*, and 1345*c*.

For example, the oil supply guide grooves 1346*a*, 1346*b*, and 1346*c*, which are enlarged to have a diameter larger than the inner diameter of the back pressure chambers 1343*a*, 1343*b*, and 1343*c*, may be respectively formed in the lower ends of the back pressure chambers 1343*a*, 1343*b*, and 1343*c*. The plurality of oil supply holes 1345*a*, 1345*b*, and 1345*c* may be formed through the inner circumferential surfaces of the respective oil supply guide grooves 1346*a*, 1346*b*, and 1346*c*, which are enlarged from the back pressure chambers 1343*a*, 1343*b*, and 1343*c*. Accordingly, before the high-pressure oil flows into the back pressure chambers 1343*a*, 1343*b*, and 1343*c*, the oil may be introduced fully into the respective oil supply guide grooves 1346*a*, 1346*b*, and 1346*c* having a larger cross-sectional area than the back pressure chambers 1343*a*, 1343*b*, and 1343*c*. Such oil may alleviate the pulsation of the back pressure supporting the vanes 1351, 1352, and 1353, thereby effectively suppressing trembling of the vanes 1351, 1352, and 1353.

The oil supply holes 1345*a*, 1345*b*, and 1345*c* according to this embodiment as described above may be formed through the rotary shaft 123 and the roller 134 and communicate with the back pressure chambers 1343*a*, 1343*b*, and 1343*c*, more specifically, the oil supply guide grooves 1346*a*, 1346*b*, and 1346*c* communicating with the back pressure chambers 1343*a*, 1343*b*, and 1343*c*, respectively. Accordingly, the back pressure chambers 1343*a*, 1343*b*, and 1343*c* (to be precise, the oil supply guide grooves) may continuously communicate with the oil storage space 110*b* through the respective oil supply holes 1345*a*, 1345*b*, and 1345*c* and the oil flow path 125. With this structure, the back pressure chambers 1343*a*, 1343*b*, and 1343*c* always forms or maintains back pressure which is predetermined pressure or higher, for example, discharge pressure or pressure close to the discharge pressure. Then, while each vane 1351, 1352, 1353 passes between the proximal point P1 and the suction port 1331, even if the front end surface 1351*a*, 1352*a*, 1353*a* faces a high pressure change, the vane 1351, 1352, 1353 may remain in contact with the inner circumferential surface 1332 of the cylinder 133 by high back pressure of the rear end surface 1351*b*, 1352*b*, 1353*b*, thereby suppressing trembling of the vane 1351, 1352, 1353.

However, in this embodiment, an inner diameter D1 of the oil supply hole 1345*a*, 1345*b*, 1345*c* may be shorter than or equal to an inner diameter D4 of the oil hole 126*a*, 126*b*. For example, as described above, the oil hole 126*a*, 126*b* may be formed through the rotary shaft 123 from the middle of the oil flow path 125 toward the main bearing surface 1312*b* or the sub bearing surface 1322*b*, and the inner diameter D1 of the oil supply hole 1345*a*, 1345*b*, 1345*c* may be shorter than or equal to the inner diameter D4 of the oil hole 126*a*, 126*b*. Accordingly, even if the back pressure chambers 1343*a*, 1343*b*, and 1343*c* (oil supply guide grooves) continuously communicate with the oil storage space 110*b* through the oil supply holes 1345*a*, 1345*b*, and 1345*c* and the oil flow path 125, an excessive increase in back pressure that supports the rear end surfaces 1351*b*, 1352*b*, and 1353*b* of the vanes 1351, 1352, and 1353 may be suppressed, thereby restricting over-adhesion in a section excluding the vicinity of the proximal point P1, resulting in reducing friction loss.

Although not illustrated in the drawings, the oil supply guide grooves 1346*a*, 1346*b*, and 1346*c* may alternatively be formed in upper ends of the back pressure chambers 1343*a*, 1343*b*, and 1343*c* facing the main bearing 131. In other words, in the previous embodiment, the oil supply guide grooves 1346*a*, 1346*b*, and 1346*c* are formed in the lower ends of the back pressure chambers 1343*a*, 1343*b*, and 1343*c* facing the sub bearing 132, but in some cases, the oil supply guide grooves 1346*a*, 1346*b*, and 1346*c* may be formed in the upper ends of the back pressure chambers 1343*a*, 1343*b*, and 1343*c*, and the oil supply holes 1345*a*, 1345*b*, and 1345*c* may be inclined upward from the middle of the oil flow path 125 toward the oil supply guide grooves 1346*a*, 1346*b*, and 1346*c*. In this case, as the oil supply holes 1345*a*, 1345*b*, and 1345*c* are formed in a forward direction relative to an oil suction direction, oil suctioned through the oil flow path 125 can flow into the oil supply guide grooves 1346*a*, 1346*b*, and 1346*c* more quickly through the oil supply holes 1345*a*, 1345*b*, and 1345*c*.

In addition, in the previous embodiment, the first back pressure pocket as a low-pressure part or portion and the second back pressure pocket as a high-pressure part or portion are formed in the main bearing 131 and the sub bearing 132, respectively. However, in this embodiment, the oil supply holes 1345*a*, 1345*b*, and 1345*c* may communicate with the back pressure chambers 1343*a*, 1343*b*, and 1343*c*, respectively, which may result in excluding the first back pressure pockets 1315*a* and 1325*a* and the second back pressure pockets 1315*b* and 1325*b*. With this structure, support rigidity may be secured on the main bearing surface 1312*b* and the sub bearing surface 1322*b* surrounding the rotary shaft 123, friction loss may be suppressed between both upper and lower surfaces of the vanes 1351, 1352, and 1353 and the main bearing 131 and the sub bearing 132 facing the both surfaces, and the main bearing 131 and the sub bearing 132 may be easily manufactured.

Also, it may be more effective in the vane rotary compressor according to embodiments when a high-pressure refrigerant, such as R32, R410a, or $CO_2$ is used. For example, a greater pressure difference between a compression surface and a compression rear surface of each vane 1351, 1352, 1353 in a section between the proximal point P1 and the suction port 1331 may be generated in a case of using a high-pressure refrigerant than that in a case of using a medium/low-pressure refrigerant, such as R134a. Accordingly, when the high-pressure refrigerant is used, the trembling of the vane 1351, 1352, 1353 may increase between the proximal point P and the suction port 1331, but the trembling of the vane 1351, 1352, 1353 may be effectively suppressed by increasing the back pressure applied to the corresponding section as illustrated in embodiments. This may suppress leakage between compression chambers, as well as noise and wear due to trembling of the vane.

In addition, in the previous embodiments, the back pressure chamber 1343*a*, 1343*b*, 1343*c* are formed larger inside of the vane slot 1342*a*, 1342*b*, 1342*c* (that is, toward the center of the roller). However, the back pressure chamber 1343*a*, 1343*b*, 1343*c* may alternatively be formed with the same cross-sectional area as the vane slot 1342*a*, 1342*b*, 1342*c*. In this case, as the back pressure chamber 1343*a*, 1343*b*, 1343*c* is a portion extending from the vane slot 1342*a*, 1342*b*, 1342*c*, and is not clearly distinguished from the back pressure chamber 1343*a*, 1343*b*, 1343*c*, it may be understood that the oil supply guide groove 1346*a*, 1346*b*, 1346*c* communicates with the vane slot 1342*a*, 1342*b*, 1342*c*. However, for convenience of description, the back pressure chamber 1343*a*, 1343*b*, 1343*c* is illustrated separate from the vane slot 1342*a*, 1342*b*, 1342*c*. Thus, it may be limitedly understood that the oil supply guide groove 1346*a*, 1346*b*, 1346*c* communicates with the back pressure chamber 1343*a*, 1343*b*, 1343*c*.

The invention claimed is:

1. A rotary compressor, comprising:

a casing that defines an oil storage space therein;

a cylinder fixed in the casing to form a compression space;

a main bearing and a sub bearing disposed on both sides of the cylinder in an axial direction and having a main bearing hole and a sub bearing hole formed therethrough, respectively, in the axial direction;

a rotary shaft supported by being inserted through the main bearing hole and the sub bearing hole;

a roller disposed in the rotary shaft to be eccentric with respect to the compression space, and having at least one vane slot formed along an outer circumferential surface of the roller, and a back pressure chamber that communicates with an inner end of the at least one vane slot; and at least one vane slidably inserted into the at least one vane slot and having a front end surface in contact with an inner circumferential surface of the cylinder to divide the compression space into a plurality of compression chambers, wherein an oil supply hole is formed through the main bearing or the sub bearing such that the back pressure chamber communicates with the oil storage space, wherein an oil through which oil stored in the oil storage space of the casing is suctioned is formed in a hollow shape inside of the rotary shaft, wherein a plurality of back pressure pockets that communicates with the oil so as to have different pressures is disposed in the main bearing or the sub bearing, wherein the plurality of back pressure pockets is disposed at predetermined distances in a circumferential direction in a surface facing an axial side surface of the roller, and wherein the oil supply hole is formed between the plurality of back pressure pockets such that at least a portion of the oil supply hole overlaps the back pressure chamber in the axial direction.

2. The rotary compressor of claim 1, wherein the sub bearing comprises:

a sub plate portion coupled to a side surface of the cylinder in the axial direction; and a sub bush portion that extends axially from the sub plate portion and having the sub bearing hole formed therethrough, and wherein the oil supply hole is formed through the sub bush portion.

3. The rotary compressor of claim 2, wherein the oil supply hole is formed through the sub bush portion between an axial end surface of the sub bush portion and a surface of the sub plate portion facing the roller.

4. The rotary compressor of claim 2, wherein the oil supply hole is formed to extend through the sub bush portion between an inner circumferential surface of the sub bearing hole and a surface of the sub plate portion facing the roller.

5. The rotary compressor of claim 4, wherein an oil groove is formed in the inner circumferential surface of the sub bearing hole, and wherein the oil supply hole is configured to communicate with a middle portion of the oil groove.

6. The rotary compressor of claim 1, wherein the sub bearing comprises:

a sub plate portion coupled to a side surface of the cylinder in the axial direction; and a sub bush portion that extends axially from the sub plate portion and having the rotary shaft inserted therethrough to be supported thereby, and wherein the oil supply hole is formed through the sub plate portion.

7. The rotary compressor of claim 6, wherein the oil supply hole extends at an incline through between both side surfaces of the sub plate portion in the axial direction.

8. The rotary compressor of claim 6, wherein the oil supply hole comprises a first hole portion that extends radially from an outer circumferential surface of the sub plate portion, and a second hole portion that extends from an inside of the first hole portion toward an axial side surface of the sub plate portion.

9. The rotary compressor of claim 1, wherein the sub bearing comprises:

a sub plate portion coupled to a side surface of the cylinder in the axial direction; and a sub bush portion that extends from the sub plate portion in the axial direction and having the sub bearing hole formed therethrough, wherein an oil pump is further disposed in the sub bush portion, and wherein the oil supply hole communicates with an outlet of the oil pump.

10. The rotary compressor of claim 1, wherein an inner diameter of the oil supply hole is smaller than or equal to an inner diameter of the back pressure chamber.

11. The rotary compressor of claim 1, wherein the oil supply hole is formed such that an inner diameter thereof of the oil supply hole at an upper end facing the roller is larger than or equal to an inner diameter at a lower end facing to the oil storage space.

12. The rotary compressor of claim 1, wherein the oil supply hole includes a communication groove facing the roller and formed between a side surface of an upper end of the oil supply hole and one of the plurality of back pressure pockets facing the side surface of the upper end of the oil supply hole in the circumferential direction.

13. A rotary compressor, comprising:

a casing that defines an oil storage space therein;

a cylinder fixed inside of the casing;

a main bearing and a sub bearing coupled to the cylinder to form a compression space together with the cylinder;

a rotary shaft supported in a radial direction by the main bearing and the sub bearing;

a roller disposed in the rotary shaft to be eccentric with respect to the compression space, and having at least one vane slot formed along an outer circumferential surface, and a back pressure chamber that communicates with an inner end of the vane slot; and at least one vane slidably inserted into the vane slot and having a front end surface in contact with an inner circumferential surface of the cylinder to divide the compression space into a plurality of compression chambers, wherein an oil is formed in a hollow shape inside of the rotary shaft, wherein an oil supply guide groove that communicates with the back pressure chamber is disposed in an axial side surface of the roller, wherein an oil supply hole is formed through an inner circumferential surface of the oil passage toward an inner circumferential surface of the oil supply guide groove, and wherein a cross-sectional area of oil supply guide groove is larger than a cross-sectional area of the back pressure chamber.

14. A rotary compressor, comprising:

a casing that defines an oil storage space therein;

a cylinder fixed in the casing to form a compression space;

a main bearing and a sub bearing disposed on both sides of the cylinder in an axial direction and having a main bearing hole and a sub bearing hole formed therethrough, respectively, in the axial direction;

a rotary shaft supported by being inserted through the main bearing hole and the sub bearing hole;

a roller disposed in the rotary shaft to be eccentric with respect to the compression space, and having at least one vane slot formed along an outer circumferential surface thereof, and a back pressure chamber that communicates with an inner end of the vane slot;

at least one vane slidably inserted into the vane slot and having a front end surface in contact with an inner circumferential surface of the cylinder to divide the compression space into a plurality of compression chambers; and an oil supply hole formed through the main bearing or the sub bearing, wherein a first end of the oil supply hole is in communication with the oil storage space and a second end of the oil supply hole is located in a rotational path of the back pressure chamber, wherein the oil supply hole includes a communication groove formed between a side surface of the second end of the oil supply hole and a side surface of one of a plurality of back pressure pockets disposed in the main bearing or the sub bearing.

15. The rotary compressor of claim 14, wherein an oil passage through which oil stored in the oil storage space of the casing is suctioned is formed inside of the rotary shaft, wherein the plurality of back pressure pockets communicates with the oil passage so as to have different pressures, wherein the plurality of back pressure pockets is disposed at predetermined distances in a circumferential direction in a surface facing an axial side surface of the roller, and wherein the oil supply hole is formed between the plurality of back pressure pockets such that at least a portion thereof overlaps the back pressure chamber in the axial direction.

16. The rotary compressor of claim 15, wherein an inner diameter of the oil supply hole is smaller than or equal to an inner diameter of the back pressure chamber.

* * * * *